US011049485B2

(12) United States Patent
Hakuta

(10) Patent No.: US 11,049,485 B2
(45) Date of Patent: Jun. 29, 2021

(54) SOUNDPROOF STRUCTURE

(71) Applicant: FUJIFILM Corporation, Tokyo (JP)

(72) Inventor: Shinya Hakuta, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 28 days.

(21) Appl. No.: 16/423,372

(22) Filed: May 28, 2019

(65) Prior Publication Data

US 2019/0295521 A1 Sep. 26, 2019

Related U.S. Application Data

(63) Continuation of application No. PCT/JP2017/041794, filed on Nov. 21, 2017.

(30) Foreign Application Priority Data

Nov. 29, 2016 (JP) ..... JP2016-231477

(51) Int. Cl.
*G10K 11/168* (2006.01)
*G10K 11/172* (2006.01)
(Continued)

(52) U.S. Cl.
CPC ..... *G10K 11/168* (2013.01); *E04B 1/86* (2013.01); *G10K 11/16* (2013.01); *G10K 11/172* (2013.01)

(58) Field of Classification Search
CPC .... G10K 11/16; G10K 11/168; G10K 11/172; E04B 1/86
(Continued)

(56) References Cited

U.S. PATENT DOCUMENTS 4,787,473 A * 11/1988 Fuchs ..... F16L 55/033 181/224
2002/0153199 A1* 10/2002 Schroer ..... G10K 11/172 181/286
(Continued)

FOREIGN PATENT DOCUMENTS

JP 7-175485 A 7/1995
JP 8-30277 A 2/1996
(Continued)

OTHER PUBLICATIONS

Min Yang et al., "Subwavelength total acoustic absorption with degenerate resonators", Applied Physics Letters, Sep. 11, 2015, 6 pages, vol. 107 (pp. 104104-1 to 104014-5).
(Continued)

*Primary Examiner* — Forrest M Phillips
(74) *Attorney, Agent, or Firm* — Sughrue Mion, PLLC

(57) ABSTRACT

A soundproof structure includes two or more kinds of resonant type sound absorbing cells including different kinds of a first resonant type sound absorbing cell and a second resonant type sound absorbing cell that are adjacent to each other; and an opening part provided in the second resonant type sound absorbing cell, in which a resonance frequency of the first resonant type sound absorbing cell and a resonance frequency of the second resonant type sound absorbing cell match each other. As a result, the soundproof structure is capable of achieving an absorptance of more than 50%, preferably, close to 100% even in a compact, light, and thin structure which is much smaller than a wavelength, thereby obtaining a high soundproofing effect. Further, the soundproof structure is capable of obtaining air permeability and/or heat conductivity by providing a passage of air and/or heat.

17 Claims, 4 Drawing Sheets

(51) Int. Cl.
*E04B 1/86* (2006.01)
*G10K 11/16* (2006.01)

(58) Field of Classification Search
USPC ..... 181/286
See application file for complete search history.

(56) References Cited

U.S. PATENT DOCUMENTS

| | | | | |
|---|---|---|---|---|
| 2005/0194209 | A1* | 9/2005 | Yang | G10K 11/172 181/286 |
| 2016/0027427 | A1* | 1/2016 | Yang | G10K 11/172 181/286 |
| 2016/0071507 | A1* | 3/2016 | Kim | E01F 8/0005 181/286 |
| 2017/0341186 | A1 | 11/2017 | Hakuta et al. | |
| 2018/0082668 | A1* | 3/2018 | Yamazoe | G10K 11/16 |
| 2020/0143784 | A1* | 5/2020 | Huang | E04F 13/075 |

FOREIGN PATENT DOCUMENTS

| | | | |
|---|---|---|---|
| JP | 2009-139556 | A | 6/2009 |
| JP | 2009-145740 | A | 7/2009 |
| JP | 2009145740 | * | 7/2009 |
| JP | 2009-198902 | A | 9/2009 |
| JP | 4832245 | B2 | 12/2011 |
| JP | 2014-240975 | A | 12/2014 |
| JP | 2016-164642 | A | 9/2016 |
| WO | 2016/136973 | A1 | 9/2016 |

OTHER PUBLICATIONS

International Search Report for PCT/JP2017/041794 dated Feb. 13, 2018 [PCT/ISA/210].
International Preliminary Report on Patentability for PCT/JP2017/041794 dated Mar. 12, 2019 [PCT/IPEA/409].
Communication dated Nov. 15, 2019, from the European Patent Office in counterpart European Application No. 17876966.7.
Written Opinion for PCT/JP2017/041794 dated Feb. 13, 2018 [PCT/ISA/237].

* cited by examiner

SOUNDPROOF STRUCTURE

CROSS-REFERENCE TO RELATED APPLICATIONS

This application is a Continuation of PCT International Application No. PCT/JP2017/041794 filed on Nov. 21, 2017, which claims priority under 35 U.S.C. § 119(a) to Japanese Patent Application No. 2016-231477 filed on Nov. 29, 2016. The above application is hereby expressly incorporated by reference, in its entirety, into the present application.

BACKGROUND OF THE INVENTION

1. Field of the Invention

The present invention relates to a soundproof structure, and particularly, relates to a soundproof structure capable of achieving a high absorptance of sound by using two or more kinds of resonant type sound absorbing cells and of secondarily obtaining air permeability and/or heat conductivity.

2. Description of the Related Art

Since the heavier the mass of a general sound insulation material of the related art, the better the sound is shielded, the sound insulation material itself becomes large and heavy in order to obtain a favorable sound insulation effect. Meanwhile, it is difficult to shield sound having a low-frequency component in particular. In general, in a case where this region is called the mass law and the frequency has doubled, it has been known that the shielding is increased by 6 dB.

As stated above, since most soundproof structures of the related art have performed sound insulation with the mass of the structure, there is a disadvantage that the soundproof structure becomes large and heavy and it is difficult to perform low-frequency shielding.

Thus, there is a need for a light and thin sound insulation structure as a sound insulation material corresponding to various fields such as devices, automobiles, and general households. Therefore, a sound insulation structure which attaches a frame to a thin and light film structure and controls vibration of a film has gathered attention (see JP4832245B and JP2009-139556A).

In the case of this structure, since the principle of the sound insulation follows the stiffness law different from the mass law, it is possible to further shield a low-frequency component even in a thin structure. This region is called the stiffness law, and behaves similarly in a case where the film has a finite size matched with a size of a frame opening due to the fixation of film vibration in a frame portion.

JP4832245B discloses a sound absorbing body that has a frame body which has a through-hole formed therein and a plate-shaped or film-shaped sound absorbing material which covers one opening of the through-hole. Two storage moduli of the sound absorbing material are respectively in predetermined ranges (see Abstract, Claim 1, paragraphs [0005] to [0007] and [0034], and the like).

The sound absorbing body disclosed in JP4832245B is used in a state in which the other surface of the frame body adheres to and is fixed to a processed surface so that the other opening of the through-hole of the frame body is closed and a rear air layer which is surrounded by the frame body is formed between the sound absorbing material which covers the one opening and the processed surface.

In JP4832245B, both a sound absorption frequency and an absorption rate are correlated with a thickness of the rear air layer (a thickness of the frame body) and a diameter of the through-hole of the frame body. As the thickness becomes thicker and the diameter becomes larger, the sound absorption frequency is decreased, and the absorption rate is increased. Thus, the sound absorbing body disclosed in JP4832245B can achieve an advanced sound absorption effect in the low-frequency region without increasing the size thereof.

JP2009-139556A discloses a sound absorbing body which is covered with a film material (film-shaped sound absorbing material) that covers a cavity opening part which is partitioned by a partition wall as a frame and is closed by a posterior wall (stiff wall) using a plate-shaped member so that a front portion forms an opening part. A pressing plate is placed on the film material. In the sound absorbing body, a resonance hole for a Helmholtz resonance is formed in a region (corner portion) within a range of 20% of a dimension of a surface of the film-shaped sound absorbing material from a fixed end of a peripheral portion of the opening part which is a region in which displacement due to sound waves of the film material is least likely to be caused. In the sound absorbing body, the cavity is blocked except for the resonance hole. This sound absorbing body performs a sound absorbing action due to film vibration and a sound absorbing action due to a Helmholtz resonance.

Subwavelength total acoustic absorption with degenerate resonators, Min Yang et. al., Applied Physics Letters 107, 104104 (2015) discloses two degenerated complete composite sound absorbing bodies in which monopole and dipole resonators are combined.

A first sound absorbing body is a square flat panel that includes a single decorated membrane resonator (DMR) for the dipole resonator and a pair of coupled DMRs for the monopole resonator. Here, the coupled DMRs are obtained by bonding a rubber film with a weight in the center so as to cover openings at both ends of a large-diameter short circular tube provided in the center of the panel. The single DMR is obtained by bonding a rubber film with a weight in the center so as to cover a small-diameter circular opening formed in an edge part of the panel. In this sound absorbing body, resonance frequencies of the coupled DMRs and the single DMR substantially match each other, and an extremely high absorption rate is achieved at a frequency lower than 500 Hz due to destructive interference caused by interaction thereof. Since this sound absorbing body is used while being attached to a square tube which has a square cross-section having the same size and a short subwavelength, there is no opening for air permeation.

A second sound absorbing body includes a hybrid membrane resonator (HMR) for the monopole resonator and the single DMR for the dipole resonator. Here, the hybrid membrane resonator (HMR) for the monopole resonator is obtained by sealing a cylindrical chamber which is attached to a sidewall of the short square tube having the square cross-section and whose back side is blocked by using the rubber film with the weight in the center. The single DMR for the dipole resonator is obtained by bonding the rubber film with the weight in the center so as to cover a large-diameter circular opening formed in the center of a disk-shaped panel which is arranged in the center of the square tube and is supported by an inner wall of the square tube through a rim. In this sound absorbing body, the resonance frequencies of the HMR and the single DMR are close to each other, and the extremely high absorption rate is also achieved at the frequency lower than 500 Hz due to the destructive interference caused by the interaction thereof. Since there is a gap between an outer edge of the disk-shaped panel and the inner wall of the square tube, this sound absorbing body has air permeability.

SUMMARY OF THE INVENTION

Incidentally, since most of the soundproof structures of the related art have performed the sound insulation with the mass of the structure, there is a disadvantage that the soundproof structure becomes large and heavy and it is difficult to perform low-frequency shielding.

Since the sound absorbing body disclosed in JP4832245B has a light weight and a high absorption rate whose peak value is 0.5 or more, it is possible to achieve the advanced sound absorption effect in a low-frequency region in which a peak frequency is 500 Hz or less. However, there is a problem that a range capable of selecting the sound absorbing material is narrow and it is difficult to select the sound absorbing material.

Since sound absorption using the coupling of the film vibration and the rear air layer is used as the principle, a thick frame and a rear wall are necessary in order to satisfy a condition. Thus, a place or a size to be provided is greatly restricted.

Since the sound absorbing material of such a sound absorbing body completely closes the through-hole of the frame body, this sound absorbing body has no ability to cause wind and heat to pass and is not able to exhaust air. Thus, the sound absorbing body tends to be filled with heat. Accordingly, in particular, there is a problem that such a sound absorbing material does not cope with sound insulation of noise of a device and an automobile or noise within a duct requiring air permeability, which is disclosed in JP4832245B.

In JP2009-139556A, since it is necessary to use the combination of the sound absorbing action due to the film vibration with the sound absorbing action due to the Helmholtz resonance, the posterior wall of the partition wall as the frame is blocked by the plate-shaped member. Thus, similarly to JP4832245B, the sound absorbing body disclosed in JP2009-139556A has no ability to cause wind and heat to pass and is not able to exhaust air, and thus, this sound absorbing body tends to be filled with heat. Accordingly, there is a problem that this sound absorbing material does not cope with sound insulation of noise of a device and an automobile or noise within a duct requiring air permeability.

The sound absorbing body disclosed in Subwavelength total acoustic absorption with degenerate resonators, Min Yang et. al., Applied Physics Letters 107, 104104 (2015) can be used at the frequency lower than 500 Hz and can achieve the extremely high absorption rate. However, since the film needs the weight, there are the following problems.

Since the weight is necessary, the structure becomes heavy, and thus it is difficult to use this sound absorbing body in devices, automobiles, and general households.

There is no easy means for arranging the weight in each cell structure, and there is no manufacturing suitability.

Since a vibration mode is changed depending on a position of the weight by using the weight, the frequency depends on the position of the weight and thus it is difficult to perform adjustment.

That is, since the frequency and magnitude of the shielding greatly depend on the heaviness of the weight and the position of the weight on the film, this sound absorbing body has low robustness and has no stability, as the sound insulation material.

There is a problem that it is not possible to obtain an absorptance of more than 50% unless a rear surface is closed as in the sound absorbing bodies described in JP4832245B and JP2009-139556A and the first sound absorbing body described in Subwavelength total acoustic absorption with degenerate resonators, Min Yang et. al., Applied Physics Letters 107, 104104 (2015). However, in a case where the rear surface is closed, since it is not possible to obtain a passage of wind or heat, it is difficult to manufacture a small high-sound-absorption soundproof structure that can be used for the duct requiring the air permeability. A plurality of soundproof structures is arranged, and thus, the volume of all the soundproof structures becomes large. There is a need for a soundproof structure having a smaller size and a high absorptance, as the soundproof structure requiring space saving such as the duct.

A main object of the present invention is to provide a soundproof structure which is capable of solving the problems of the related art, and is capable of achieving an absorptance of more than 50%, preferably, close to 100% even in a compact, light, and thin structure which is much smaller than a wavelength, thereby obtaining a high soundproofing effect. Further, the soundproof structure is capable of achieving air permeability and/or heat conductivity by providing a passage of air and/or heat. As a result, a main object of the present invention is to provide a soundproof structure which is capable of being arranged for soundproof of devices, automobiles, and general households.

In addition to the main objects, another object of the present invention is to provide a soundproof structure which has high robustness as the sound insulation material without sound insulation characteristics such as a shielding frequency and a size depending on the shape thereof, has stability, is suitable for the purpose of devices, automobiles, and general households, and has excellent manufacturing suitability.

In the present invention, "soundproof" includes the meaning of both "sound insulation" and "sound absorption" as acoustic characteristics, but in particular, refers to "sound insulation". Here, "sound insulation" refers to "shielding sound", that is, "not allowing sound to pass through". Therefore, "soundproof" includes "reflecting" sound (reflection of sound) and "absorbing" sound (absorption of sound) (refer to Sanseido Daijirin (Third Edition) and http://www.onzai.or.jp/question/soundproof.html and http://www.onzai.or.jp/pdf/new/gijutsu201312_3.pdf on the web page of Acoustical Materials Association of Japan).

Hereinafter, basically, "sound insulation" and "shielding" are referred to in a case where "reflection" and "absorption" are not distinguished from each other. However, "reflection" and "absorption" are referred to in a case where "reflection" and "absorption" are distinguished from each other.

In order to achieve the objects, the present inventors have found out that it is difficult to cause the absorptance of more than 50% in the compact region which is much smaller than the wavelength by using the typical soundproof structure and it is necessary to use near-field interference between cells. Meanwhile, the present inventors have found out that it is necessary to provide a passage of air and/or heat since there are many fields in which secondarily, air permeability and/or heat conductivity is required and a high soundproofing effect is also achieved for soundproofing within the device. As a result, the present inventors have derived the present invention.

That is, a soundproof structure according to the embodiment of the present invention includes two or more kinds of resonant type sound absorbing cells including different kinds of a first resonant type sound absorbing cell and a second resonant type sound absorbing cell that are adjacent to each other; and an opening part provided in the second resonant type sound absorbing cell, in which a resonance frequency of the first resonant type sound absorbing cell and a resonance frequency of the second resonant type sound absorbing cell match each other.

Here, it is preferable that the first resonant type sound absorbing cell includes a frame which has an opening, and a film which is fixed around the opening of the frame and covers the opening.

It is preferable that the film is a single-layer film.

It is preferable that a first resonance frequency of the first resonant type sound absorbing cell including the film and a first resonance frequency of the second resonant type sound absorbing cell match each other.

It is preferable that the second resonant type sound absorbing cell includes a frame having an opening, and at least two layers of plates which include through-holes, respectively, and are fixed around the opening of the frame.

It is preferable that the at least two layers of plates are two layers of plates which respectively include the through-holes, are fixed around both sides of the opening of the frame, and cover the opening.

It is preferable that the opening part includes the through-holes of the at least two layers of plates.

It is preferable that the at least two layers of plates respectively including the through-holes are the same as each other.

It is preferable that the resonance frequencies matched in the first resonant type sound absorbing cell and the second resonant type sound absorbing cell are included in a range of 10 Hz to 100000 Hz.

It is preferable that, assuming that a wavelength at the resonance frequency is λ, the first resonant type sound absorbing cell that satisfies a condition in which a distance between the first resonant type sound absorbing cell and the second resonant type sound absorbing cell closest to the first resonant type sound absorbing cell is less than/4 occupies 60% or more of all of the first resonant type sound absorbing cells.

According to the present invention, it is possible to achieve an absorptance of more than 50%, preferably, close to 100% even in a compact, light, and thin structure which is much smaller than a wavelength, thereby obtaining a high soundproofing effect.

According to the present invention, it is possible to secondarily secure air permeability and/or heat conductivity by providing a passage of air and/or heat, the structure can be arranged for soundproof of devices, automobiles, and general households.

According to the present invention, it is possible to provide a soundproof structure which has high robustness as the sound insulation material without sound insulation characteristics such as a shielding frequency and a size depending on the shape thereof, has stability, is suitable for the purpose of devices, automobiles, and general households, and has excellent manufacturing suitability.

In addition, according to the present invention, since the sound absorbing cell does not have a weight and uses a simple film and a plate hole, it is possible to provide a soundproof structure in which matching of frequencies of respective cells is easy.

DESCRIPTION OF THE PREFERRED EMBODIMENTS

Figure 1:
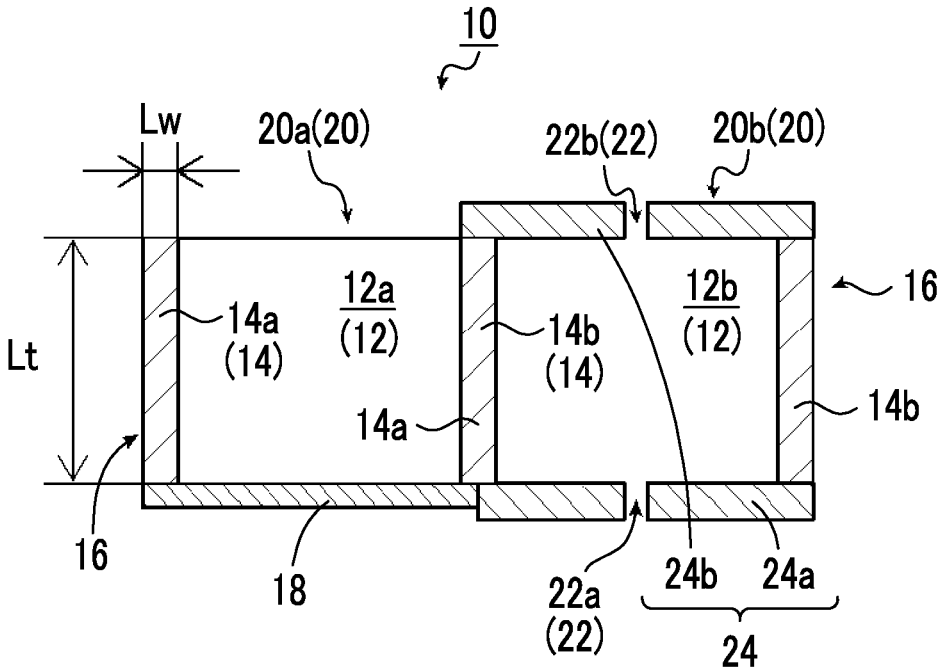
FIG. 1 is a schematic cross-sectional view showing an example of a soundproof structure according to an embodiment of the present invention.

Hereinafter, a soundproof structure according to embodiments of the present invention will be described in detail with reference to preferred embodiments shown in the accompanying diagrams.

The soundproof structure according to the embodiment of the present invention is a structure which achieves an absorptance of more than 50%, preferably, close to 100% to obtain a high soundproofing effect, and secondarily secures a passage of heat and/or air.

In the present invention, a method in which transmitted waves of a plurality of resonant type sound absorbing cells are removed due to the interference and absorption is increased by causing interference with which the transmitted waves cancel each other is used as a principle to obtain an absorptance of more than 50%, preferably close to 100%. In order to achieve this, it is necessary that the phases of the transmitted waves are inverted with respect to the incident waves between two resonant type sound absorbing cells.

Therefore, the soundproof structure according to the present invention needs to have two or more types of resonant type sound absorbing cells that are adjacent to each other and that include different types of a first resonant type sound absorbing cell and a second resonant type sound absorbing cell. Further, in the soundproof structure of the present invention, the resonance frequency of the first resonant type sound absorbing cell (for example, preferably the first resonance frequency) and the resonance frequency of the second resonant type sound absorbing cell (for example, preferably the lowest order (first) resonance frequency) need to match each other.

In the present invention, the description that at least a part of the first resonant type sound absorbing cells and at least a part of the second resonant type sound absorbing cells are adjacent (for example, two resonant type sound absorbing cells are adjacent) means that the two resonant type sound absorbing cells are in contact with each other without any gap (for example, the side surfaces of the resonant type sound absorbing cells are closely attached to each other without being shifted), but the present invention is not limited thereto. In the present invention, as long as sound can cancel each other due to interference caused by changes in phases of the two resonant type sound absorbing cells, the two resonant type sound absorbing cells may not be closely attached to each other, and may be arranged at an interval. In the present invention, the two resonant type sound absorbing cells, for example, the side surfaces thereof may be shifted.

In the present invention, a vibration film structure whose surrounding is fixed a frame is used as a first resonant type sound absorbing cell which is one of the two adjacent resonant type sound absorbing cells. For example, the phases of the transmitted waves are inverted at the first resonance frequency due to displacement of a single-layer film.

Accordingly, a structure in which the phases of the transmitted waves are not inverted may be used as the second resonant type sound absorbing cell which is the other of the two adjacent resonant type sound absorbing cells.

Specifically, as the second resonant type sound absorbing cell, it is preferable to use a sound absorbing cell having a multilayer plate structure in which plates provided with through-holes are in multiple layers. The second resonant type sound absorbing cell has a configuration as in a Helmholtz resonator having through-holes formed in both sides due to the expansion and compression of air confined in a central portion. At this time, a mode in which sound travels in opposite directions to the plate-holes on both the sides is used.

However, the present invention is not limited thereto, and a relationship in which the phases of the transmitted waves of the first resonant type sound absorbing cell and the phases of the transmitted waves of the second resonant type sound absorbing cell cancel each other may be satisfied. For example, even though the first resonant type sound absorbing cell has not the first resonance frequency but higher-order resonance frequency, since the phases are changed, the second resonant type sound absorbing cell having the phases of the transmitted waves for canceling the phase changes may be used.

Here, the through-hole is for contributing to the friction of Helmholtz, not only for air permeation. The soundproof structure according to the embodiment of the present invention is obtained by a combination of commonly used resonant sound absorbing bodies such as films and Helmholtz, but the combination is novel, and a novel effect of "achieving an absorptance of more than 50% with a structure including an opening such as a through-hole" is achieved.

An embodiment of the present invention is a soundproof structure in which the resonances (resonance frequencies) of a soundproof cell in which two or more plates provided with through-holes are disposed at an interval, and another soundproof cell with single-layer film vibration match each other.

As described above, in the soundproof structure according to the embodiment of the present invention, the film vibration of the single-layer film is used for one cell and air friction sound absorption is used instead of film vibration for the other cell to be combined with one cell by providing an opening portion including through-holes as a friction hole not for air permeation. In this manner, the soundproof structure according to the embodiment of the present invention can achieve an absorptance of more than 50%, and can pass heat and/or air (or wind) as a secondary effect.

In the present invention, a passage of heat and/or air (wind) is provided. Therefore, the soundproof structure according to the embodiment of the invention needs to include a through-hole (opening part) functioning as a friction hole in the other second resonant type sound absorbing cell of two adjacent resonant type sound absorbing cells in addition to the two or more kinds of resonant type sound absorbing cells.

As stated above, since the plurality of resonant type sound absorbing cells individually resonate, even though the opening part (that is, through-hole) is present therein (in the sound absorbing cell), an effect of attracting sound to the resonant type sound absorbing cells is demonstrated.

Thus, the soundproof structure according to the embodiment of the invention can achieve a high absorptance by the first resonant type sound absorbing cell of the above-described vibration film structure and the second resonant type sound absorbing cell of the above described two-layers-of-perforated-plate structure being included in the two or more kinds of resonant type sound absorbing cells. That is, the soundproof structure according to the embodiment of the present invention is a structure serving as an opening structure including an opening part through which wind and/or heat pass and a resonance absorption structure due to interaction of the two resonant type sound absorbing cells.

In the present invention, since the through-holes are provided on the plates at both ends of the two-layers-of-perforated-plates structure of the second resonant type sound absorbing cell, a passage of air and/or heat can be secured.

Figure 2:
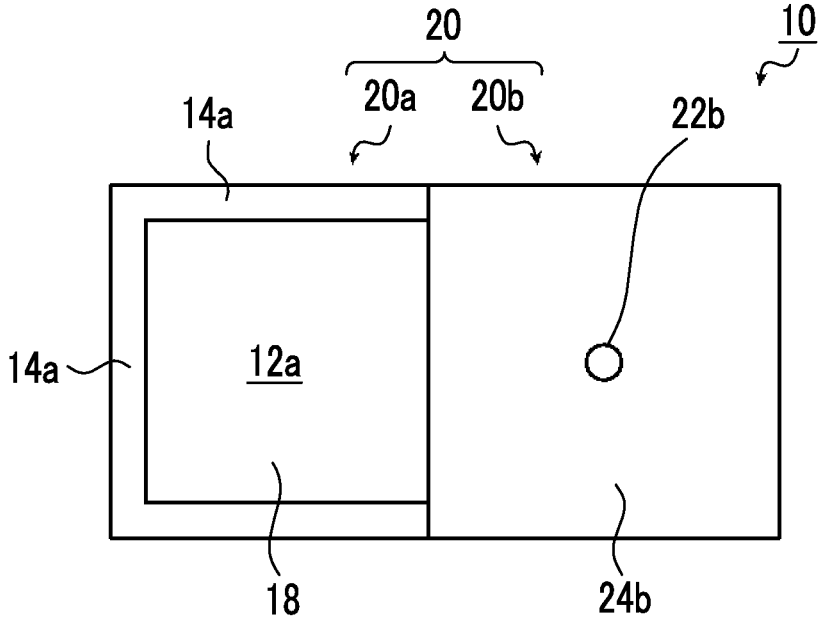
FIG. 2 is a schematic plan view of the soundproof structure shown in FIG. 1.

FIG. 1 is a schematic cross-sectional view showing an example of a soundproof structure according to an embodiment of the present invention, and FIG. 2 is a schematic plan view of the soundproof structure shown in FIG. 1.

A soundproof structure 10 according to the embodiment of the present invention shown in FIGS. 1 and 2 uses, as a first resonant type sound absorbing cell which is one sound absorbing cell according to the embodiment of the present invention, a vibration film structure in which phases are inverted due to the displacement of the single-layer film of which surrounding is fixed to the frame, and uses the two-layers-of-perforated-plates structure described above as a second resonant type sound absorbing cell which is the other sound absorbing cell according to the embodiment of the present invention. The two-layers-of-perforated-plates structure has a configuration as in a Helmholtz resonator having through-holes formed in both sides due to the expansion and compression of air confined in a central portion thereof. That is, as the second resonant type sound absorbing cell, a mode in which the sound travels in opposite directions to the respective through-holes of the perforated plates on both sides is used, and a two-layers- or multi-layers-of-perforated-plate structure in which the phase is not inverted is used. At this time, it is preferable that at least the two layers of plates each having a through-hole are the same plate.

The soundproof structure 10 of the first embodiment includes two kinds of resonant type sound absorbing cells arranged so as to be adjacent to each other, for example, one first resonant type sound absorbing cell (hereinafter, simply referred to as a first sound absorbing cell or a sound absorbing cell) 20*a* and the other second resonant type sound absorbing cell (hereinafter, simply referred to as a second sound absorbing cell or a sound absorbing cell) 20*b* which has an opening part therein.

The first sound absorbing cell 20*a* and the second sound absorbing cell 20*b* have openings 12*a* and 12*b*, respectively, and comprise a frame body 16 which forms two adjacent frames 14*a* and 14*b*.

In the example shown in FIGS. 1 and 2, the frames 14*a* and 14*b* are adjacent to each other and share the members in the adjacent portion, but the present invention is not limited thereto. The respective frames 14*a* and 14*b* may be independent from each other. In this manner, in a case where the respective frames 14*a* and 14*b* are independent from each other, the frames 14*a* and 14*b* may be the same or different from each other.

The first sound absorbing cell 20*a* is the first resonant type sound absorbing cell of a single-layer vibration film structure, and comprises a film 18 which covers one end portion of the opening 12*a* of the frame 14*a*. The other end portion of the opening 12*a* is opened.

The second sound absorbing cell 20*b* is the second resonant type sound absorbing cell of a two-layers-of-perforated-plates structure and covers both end portions of the opening 12*b* of the frame 14*b*, and includes two layers of perforated plates 24 including two perforated plates 24*a* and 24*b* in which through-holes 22*a* and 22*b* (22) are respectively formed.

The through-hole 22 not only functions as a resonance hole which causes a resonance similar to the Helmholtz resonance and but also allows heat and/or air to pass therethrough.

In the present invention, a ratio (percentage %) of an area of the through-hole 22 to the sum of areas of the opening 12*a* of the first sound absorbing cell 20*a* and the opening 12*b* of the second sound absorbing cell 20*b* parallel to a surface covered by the film 18 is defined as an opening ratio.

In the present invention, the opening ratio is not particularly limited as long as the through-hole 22 functions as a Helmholtz type friction hole and secondarily allows heat and/or air to pass therethrough, and since the acoustic characteristics are determined by the pore size of the through-hole 22 to be described below, the opening ratio is determined according to the acoustic characteristics.

In the present invention, the first and second sound absorbing cells 20*a* and 20*b* are two different kinds of sound absorbing cells, and the resonance frequencies thereof match each other.

In the present invention, a case where the resonance frequency of the "first (resonant type) sound absorbing cell" and the resonance frequency of the "second (resonant type) sound absorbing cell" match each other means that a first resonance frequency of the first sound absorbing cell and a resonance frequency (preferably, first resonance frequency) of the second sound absorbing cell match each other.

As in the present invention, as long as the resonance of the sound absorbing cell 20*b* has a relationship in which the transmission phase of the resonance of the sound absorbing cell 20*b* is canceled by the transmission phase of the resonance of the sound absorbing cell 20*a*, it is possible to obtain high absorption. For example, in the case of the present invention where the first resonance frequency satisfies the condition, this condition is satisfied at the resonance of the odd-order resonance (first, third, fifth, . . . ). In particular, in the present invention, in a case where the first resonance frequency of the sound absorbing cell 20*b* is used, the size of the soundproof structure of the present invention can be minimized.

Here, any of the matching resonance frequencies, for example, the first resonance frequency of the first sound absorbing cell and the resonance frequency (preferably the first resonance frequency) of the second sound absorbing cell is preferably 10 Hz to 100000 Hz which is equivalent to a range of sound waves that can be sensed by humans, more preferably 20 Hz to 20000 Hz which is an audible range of sound waves that can be heard by humans, even more preferably 40 Hz to 16000 Hz, and most preferably 100 Hz to 12000 Hz.

The reason why the matching resonance frequencies, for example, the first resonance frequency of the first sound absorbing cell and the first resonance frequency of the second sound absorbing cell are preferably 10 Hz to 100000 Hz is that since the object of the present invention is to prevent the sound heard by humans or the sound sensed by humans through the absorption, the frequency range in which the humans can sense the sound is in this range. Since the range of 20 Hz to 20000 Hz is equivalent to the range (audible range) of the sound that can be heard by the humans, the matching resonance frequencies have more desirably this range.

In the present invention, a case where the first resonance frequency of the "first sound absorbing cell" and the first resonance frequency of the "second sound absorbing cell" match each other means that in a case where there is a difference between two resonance frequencies, that is, the first resonance frequency of the first sound absorbing cell and the first resonance frequency of the second sound absorbing cell, $\Delta F/F0$ falls within a range of 0.2 or less in which a frequency on a high frequency side is F0 and the magnitude of the difference between the two resonance frequencies is $\Delta F$. For example, in a case where F0 is 1 kHz, the difference is within ±200 Hz. $\Delta F/F0$ is more preferably 0.10 or less, even more preferably 0.05 or less, and most preferably 0.02 or less.

The reason why it is preferable that the difference between the first resonance frequency of the first sound absorbing cell and the first resonance frequency of the second sound absorbing cell satisfies that $\Delta F/F0$ is 0.2 or less is that since in a case where the difference between the resonance frequencies exceeds the above condition, both the resonance frequencies are too far apart from each other, the interaction of the frequencies in the resonant state becomes small. That is, the farther from the resonance frequency, the smaller the transmittance and absorptance in each sound absorbing cell and the larger the reflectance. For this reason, the cancellation of the transmitted waves of the respective resonant type sound absorbing cells is an important part of the present invention, but the ratio of cancellation is small and the reflectance becomes large. Therefore, it is desirable that the difference between the first resonance frequencies of both the sound absorbing cells satisfy that $\Delta F/F0$ is 0.2 or less.

Hereinafter, for the constituent elements of the two first and second sound absorbing cells 20*a* and 20*b*, the openings 12*a* and 12*b*, the frames 14*a* and 14*b*, the through-holes 22*a* and 22*b*, and the perforated plates 24*a* and 24*b* of the soundproof structure 10, a case where the constituent elements are different will be individually described. However, a case where the constituent elements are the same and do not need to be particularly distinguished from each other will be collectively described as the sound absorbing cells 20, the openings 12, the frames 14, the through-holes 22, and the perforated plates 24 without distinguishing from each other.

In the present invention, a case where the two frames 14 (14*a* and 14*b*) are different means that at least one of frame shapes (shapes of the frames 14), kinds (physical properties, stiffness, and materials) of the frames 14, or dimensions such as frame widths (plate thickness of constituent members of the frames 14: Lw), frame thicknesses (lengths of the constituent members of the frames 14=distances between both ends of the openings 12: Lt), and frame sizes (sizes of the frames 14 or sizes (sizes of opening areas and sizes of space volumes)) of the openings 12 of the frames 14) is different.

In contrast, a case where the two frames 14 (14*a* and 14*b*) are identical to each other means that at least all the shapes, kinds, and dimensions of the two frames 14 are identical to each other.

In the structure in which the first sound absorbing cell 20*a* and the second sound absorbing cell 20*b* are provided, the soundproof structure 10 of the embodiment shown in FIGS. 1 and 2 is a soundproof structure in which the configurations of the first sound absorbing cell 20*a* and the second sound absorbing cell 20*b* are adjusted such that the first resonance frequency of the first sound absorbing cell 20*a* and the first resonance frequency of the second sound absorbing cell 20*b* match each other. That is, the configuration of the frame 14*a* and the film 18 of the first sound absorbing cell 20*a* (that is, at least one of the frame shape, kind, frame width, frame thickness (distance between two layers of films), and the frame size (film size of the film 18) of the frame 14*a*, and the kind and film thickness of the film 18) and the configuration of the frame 14*b*, the perforated plates 24, and the through-holes 22 of the second sound absorbing cell 20*b* (that is, at least one of the frame shape, kind, frame width, frame thickness (distance between two layers of films), and the frame size (size of the perforated plate 24) of the frame 14*b*, the kind and plate thickness of the perforated plate 24, and the shape and size of the through-hole 22) are adjusted.

Specifically, the configurations of the frame 14, the film 18, and the perforated plate 24 with the through-hole 22 are adjusted such that the first resonance frequencies of the resonant modes in which the displacements of the air in the vicinity of the respective through-holes 22 (22*a* and 22*b*) of the two layers of perforated plates 24 (24*a* and 24*b*) move in directions opposite to each other match each other, of the first resonance frequency of the single-layer film 18 of the first sound absorbing cell 20*a* and the resonance frequency of the second sound absorbing cell 20*b*.

Figure 3:
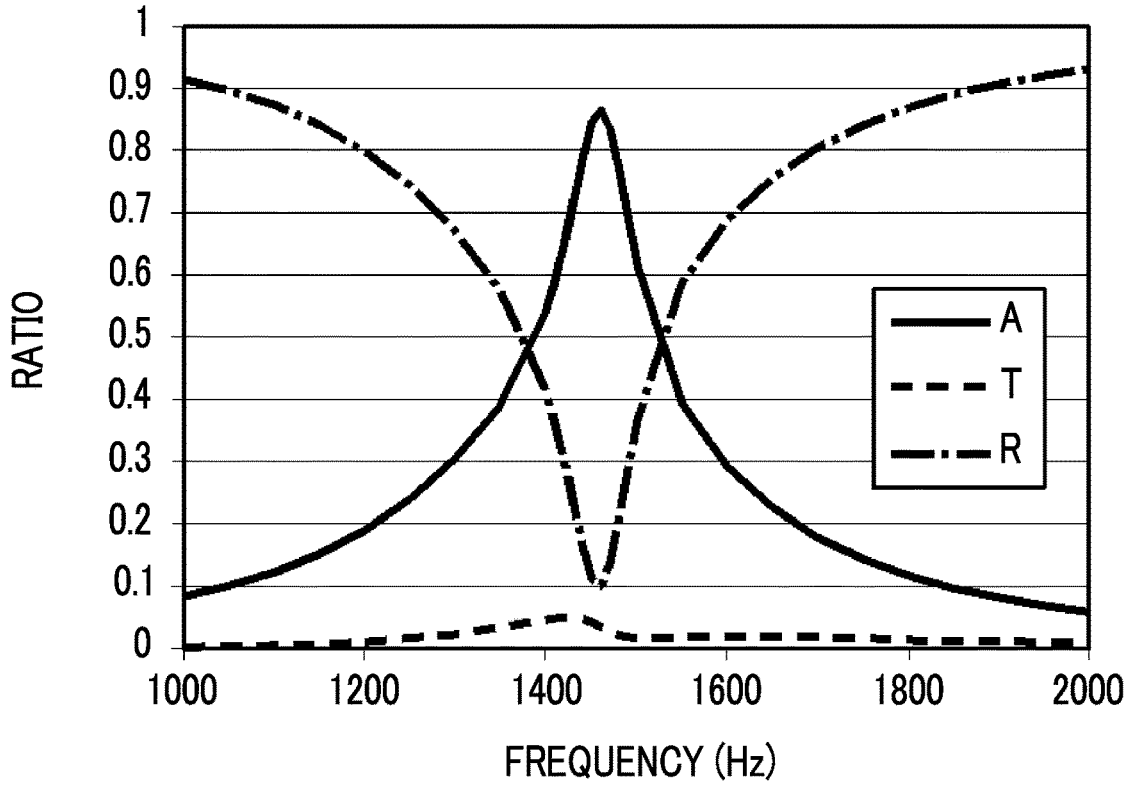
FIG. 3 is a graph showing soundproofing characteristics of Example 1 of the soundproof structure shown in FIG. 1.
Figure 4:
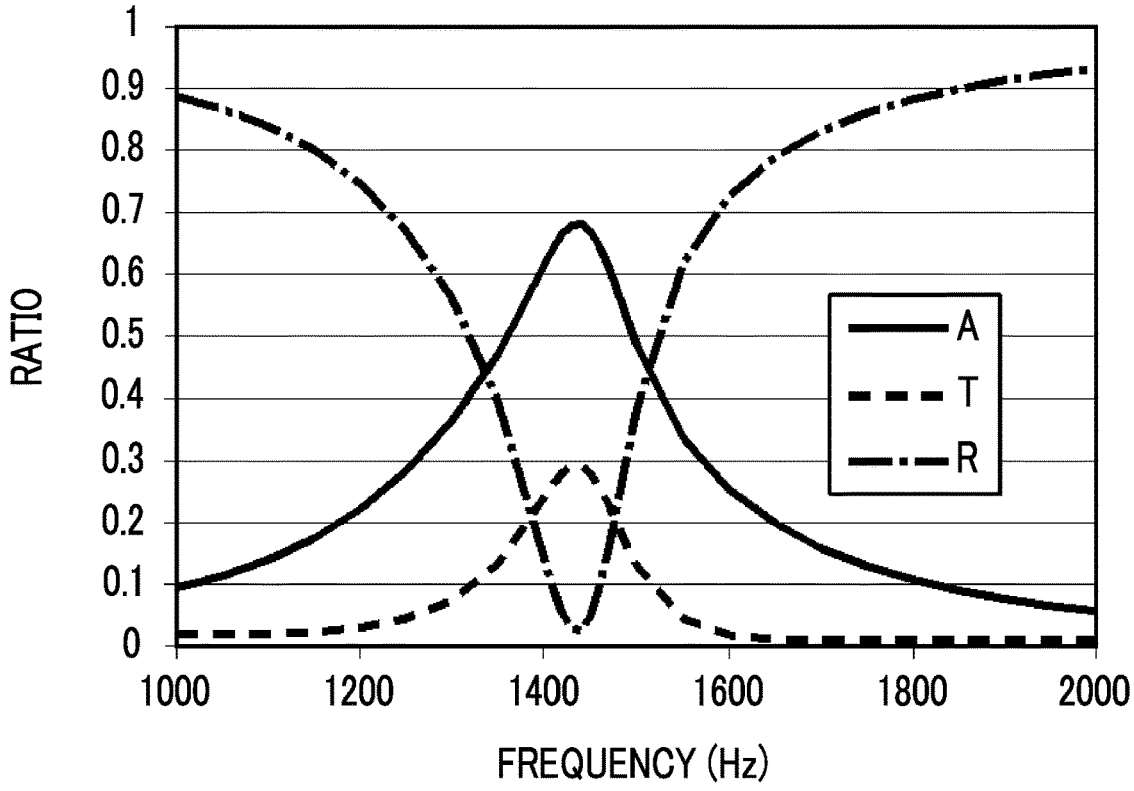
FIG. 4 is a graph showing soundproofing characteristics of Example 2 of the soundproof structure shown in FIG. 1.

As described above, the first resonance frequency of the first sound absorbing cell 20*a* and the first resonance frequency of the second sound absorbing cell 20*b* match each other, and thus, the soundproof structure 10 comprising the first sound absorbing cell 20*a* and the second sound absorbing cell 20*b* demonstrates the maximum (peak) absorptance of the sound at a specific frequency. For example, as will be described below, the soundproof structure 10 shown in FIGS. 1 and 2 demonstrates the peak (maximum) absorptance that is the maximum value of absorptance A of the sound at the maximum absorption frequency of 1460 Hz in the soundproofing characteristics of Example 1 shown in FIG. 3 and at the maximum absorption frequency of 1440 Hz in the soundproofing characteristics of Example 2 shown in FIG. 4. In other words, as shown in FIGS. 3 and 4, in the soundproof structure 10 of Examples 1 and 2, specific frequencies of 1460 Hz and 1440 Hz demonstrate the peak absorptance. The specific frequency demonstrating the peak absorptance can be referred to as an absorption peak (maximum) frequency. At this time, the absorption peak frequency can be substantially equal to the frequency (for example, the first resonance frequency of the first sound absorbing cell or the first resonance frequency of the second sound absorbing cell) matched in the first sound absorbing cell 20*a* and the second sound absorbing cell 20*b*. In addition to the absorptance, the transmittance T and the reflectance R are also shown as the soundproofing characteristics in FIGS. 3 and 4.

The soundproof structure 10 shown in FIGS. 1 and 2 matches the first resonance frequency of the film vibration of the single-layer film 18 of one sound absorbing cell (that is, the first sound absorbing cell 20*a*) of two kinds of sound absorbing cells 20 whose first resonance frequencies are different, with the first resonance frequency of the resonance due to the compression and expansion of the inside air by the friction of the respective through-holes 22 (22*a* and 22*b*) of the two layers of perforated plates 24 (24*a* and 24*b*) of the other sound absorbing cell (that is, the second sound absorbing cell 20*b*). By doing this, at the frequency (for example, the first resonance frequency of the second sound absorbing cell 20*b*) in which both the resonance frequencies match each other, it is possible to obtain a high absorptance of the sound which is much higher than 50%, which is not possible to be achieved in a soundproof structure including sound absorbing cells 20*a* and 20*b* which are independent from each other (that is, it is possible to achieve a peak absorptance).

That is, for example, the peak absorptance achieved in a soundproof structure of Comparative Example 1 including the independent sound absorbing cell 20*a* and the opening part is 40%, as shown in Table 1 to be described below. On the other hand, the soundproof structure 10 shown in FIGS. 1 and 2 is designed such that the first resonance frequency of the single-layer film 18 and the first resonance frequency of the resonance of the through-holes 22 of the two layers of perforated plates 24 match each other, thereby achieving an absorptance of the sound which is much higher than 50%, which is not possible to be achieved in a soundproof structure including the single sound absorbing cell 20*a* and the opening part. The soundproof structure 10 according to the embodiment of the present invention can achieve an absorptance of the sound which is 87% as in Example 1 shown in FIG. 3, and achieve an absorptance of the sound which is 68% as in Example 2 shown in FIG. 4. For example, the absorptance of the sound which is much higher than 50% is achieved even though the frame size, the frame thickness, or the distance between the two layers (between the films) of the frames 14 of the sound absorbing cells 20 is smaller than ¼ of the wavelength of the sound waves.

Since, in a general soundproof structure, the size of the soundproof cell is extremely smaller than the size of the wavelength of the sound waves and the general soundproof structure functions as a single structure for the sound, it is extremely difficult to realize an absorptance of 50% or more.

This can be seen from the absorptance derived by a continuity equation of the pressure of the sound waves to be represented below.

The absorptance A is determined as A=1−T−R.

The transmittance T and the reflectance R are expressed by a transmission coefficient t and a reflectance coefficient r, and $T=|t|^2$, $R=|r|^2$.

Assuming that an incidence sound pressure, a reflection sound pressure, and a transmission sound pressure are respectively $p_I$, $p_R$, and $p_T$ ($p_I$, $p_R$, and $p_T$ are complex numbers), the continuity equation of the pressure which is a basic of the sound waves which interact with the structure including the single-layer film is $p_I=p_R+p_T$. Since $T=p_T/p_I$ and $r=p_R/p_I$, the continuity equation of the pressure is expressed as follows.

$$I=t+r$$

Accordingly, the absorptance A is obtained. Re represents a real part of the complex number, and Im represents an imaginary part of the complex number.

$$\begin{aligned}
A &= 1 - T - R \\
&= 1 - |t|^2 - |r|^2 \\
&= 1 - |t|^2 - |1 - t|^2 \\
&= 1 - (\mathrm{Re}(t)^2 + \mathrm{Im}(t)^2) - (\mathrm{Re}(1-t))^2 + \mathrm{Im}(1-t))^2) \\
&= 1 - (\mathrm{Re}(t)^2 + \mathrm{Im}(t)^2) - (1 - 2\mathrm{Re}(t) + \mathrm{Re}(t)^2 + \mathrm{Im}(t))^2) \\
&= -2\mathrm{Re}(t)^2 + 2\mathrm{Re}(t) - 2\mathrm{Im}(t)^2 \\
&= 2\mathrm{Re}(t) \times (1 - \mathrm{Re}(t)) - 2\mathrm{Im}(t)^2 < 2\mathrm{Re}(t) \times (1 - \mathrm{Re}(t))
\end{aligned}$$

The equation is an equation expressed as $2x\times(1-x)$, and has a range of $0\leq x\leq 1$.

In this case, it can be seen that the absorptance has the maximum value in a case where $x=0.25$ and $2x(1-x)\leq 0.5$. Thus, it can be seen that $A<Re(t)\times(1-Re(t))\leq 0.5$ and the absorptance in the single structure is at most 0.5.

As stated above, it can be seen that the absorptance of the sound in the structure (first soundproofcell) including the single-layer film remains at 50% or less.

In the case of the structure (second soundproof cell) including the two layers of perforated plates respectively having the through-holes 22, for example, in a case where the (inter-plate) distance between the two layers is extremely smaller than the size of the wavelength of the sound (specifically, is smaller than ¼), since it is difficult to achieve the phases in which the transmitted waves cancel each other, the absorptance of the sound remains at about 50%.

As stated above, according to the soundproof structure of the present embodiment, it is possible to obtain the absorptance of the sound which is much higher than the absorptance of the related art by simply changing the frame sizes or adjusting the frame thicknesses, for example.

Although the soundproof structures 10 shown in FIGS. 1 and 2 are the structure including one first sound absorbing cell 20*a* and one second sound absorbing cell 20*b*, the present invention is not limited thereto. The present invention may adopt a structure in which a plurality of soundproof units is combined by using the soundproof structures 10 as one soundproof unit.

Figure 5:
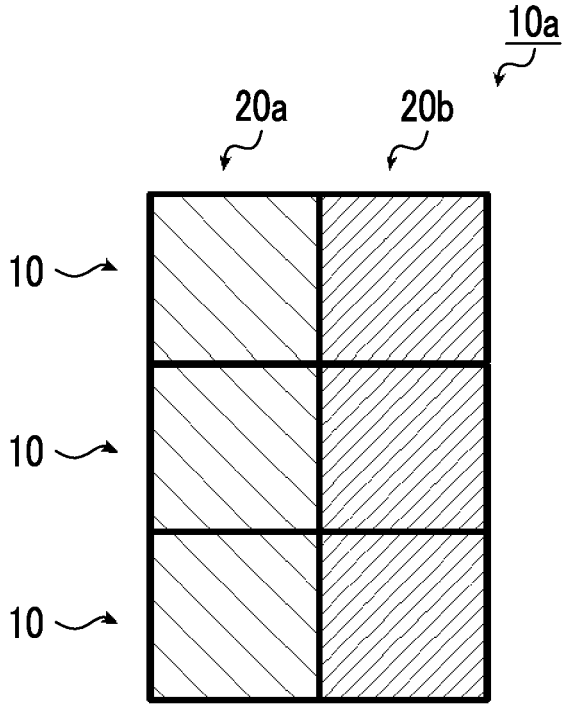
FIG. 5 is a schematic plan view of an example of a soundproof structure according to another embodiment of the present invention.

For example, as in a soundproof structure 10*a* shown in FIG. 5, a structure in which three soundproof structures 10 shown in FIG. 1 are combined in the same direction as it is, that is, three sets of the first sound absorbing cell 20*a* and one second sound absorbing cell 20*b* are combined in the same order as it is may be adopted. Further, as in a soundproof structure 10*b* shown in FIG. 6, a structure in which two soundproof structures 10 shown in FIG. 1 are used in the same direction (that is, the first and second sound absorbing cells 20*a* and 20*b* are used in the same order as it is) and the soundproof structure 10 is combined in an opposite direction (that is, in order of the second sound absorbing cell 20*b* and the first sound absorbing cell 20*a*) between the two soundproof structures 10 may be adopted. Both the soundproof structure 10*a* shown in FIG. 5 and the soundproof structure 10*b* shown in FIG. 6 have almost no difference in the soundproofing characteristics.

Although not shown, in the soundproof structure according to the embodiment of the present invention, the number of sets in which the soundproof structures 10 shown in FIGS. 1 and 2 are combined is not limited to three, and may be two or four or more.

As described above, in the present invention, the two sound absorbing cells 20*a* and 20*b* need to be adjacent to each other (that is, arranged within a distance with which the sound can cancel each other due to the interference caused by the changes in phases of the two sound absorbing cells 20*a* and 20*b*). The reason can be considered as follows.

The phases of the first sound absorbing cell 20*a* and the second sound absorbing cell 20*b* interfere with each other by changing the phases thereof, and thus, efficiency with which the waves can cancel each other is the best. In a case where there is a distance between the two sound absorbing cells 20*a* and 20*b*, since the phases are changed by the distance, an original phase difference is changed. Thus, it can be seen that the magnitude of the distance between the two sound absorbing cells is associated with the wavelength of the resonance frequency.

Here, assuming that the original phase difference between the two sound absorbing cells is $\Delta\theta$, in a case where the sound absorbing cells are adjacent to each other, the waves interfere with each other with $\Delta\theta$. Assuming that the wavelength of the resonance frequency is $\lambda$, in a case where the two sound absorbing cells are separated with a distance a, the phase difference is $\Delta\theta+a/\lambda$. In the present invention, since the adjustment is performed such that $\Delta\theta$ is $\pi$ (180°), the phase difference is shifted from the cancellation relationship by $a/\lambda$. In a case where a is $\lambda/4$, since the transmitted waves from the sound absorbing cells do not interfere with each other, it can be seen that it is preferable that the distance is less than $\lambda/4$. For example, since $\lambda$ is about 24 cm at 1400 Hz, $\lambda/4$ is about 6 cm.

From the above, in the present invention, assuming that the wavelength at the resonance frequency is $\lambda$, it is preferable that all the first resonant type sound absorbing cells that satisfy a condition the distance between the first resonant type sound absorbing cell and the second resonant type sound absorbing cell closest to the first resonant type sound absorbing cell is less than $\lambda/4$ occupy at least 60% or more of all of the first resonant type sound absorbing cells.

Here, the distance between the two sound absorbing cells is desirably less than $\lambda/4$, more desirably equal to or less than $\lambda/6$, even more desirably equal to or less than $\lambda/8$, and most desirably equal to or less than $\lambda/12$.

The ratio is desirably equal to or greater than 60%, more desirably equal to or greater than 70%, even more desirably equal to or greater than 80%, and most desirably equal to or 90%.

In the soundproof structure according to the embodiment of the present invention, at least the first resonant type sound absorbing cell and the second resonant type sound absorbing cell which are adjacent to each other, are different from each other, and have the matching resonance frequencies may be used as two kinds or more of resonant type sound absorbing cells. In the example shown in FIG. 1, the sound absorbing cell 20*a* of the frame-film structure having the frame 14*a* and the film 18 and the sound absorbing cell 20*b* of the frame-perforated plate structure having the frame 14*b* and the two layers of perforated plates 24 (24*a* and 24*b*) with the through-holes 22 (22*a* and 22*b*) are provided.

Hereinafter, each constituent element of the two kinds of sound absorbing cells 20 including the sound absorbing cell 20*a* and the sound absorbing cell 20*b* will be described.

The frame 14 of the sound absorbing cell 20 includes the frame 14*a* constituting the sound absorbing cell 20*a*, and the frame 14*b* constituting the sound absorbing cell 20*b*. Since these frames have the same configuration, these frames will be described as the frame 14, and these individual frames will be distinguishably described in a case where different cell configurations are described. Hereinafter, the frame is simply referred to as the frame 14 in a case where it is clearly understood that these frames 14 are the frames 14*a* and 14*b* of the sound absorbing cells 20.

The frame 14 is a frame member which is a thick plate-shaped member, and has the opening 12 formed so as to surround in a cyclic shape therein. The frame 14 a is for fixing the film 18 such that the film 18 covers the opening 12*a* on one side and serves as a node of the film vibration of the film 18 fixed to the frame 14. On the other hand, the frame 14*b* is for fixing the perforated plate 24 with the through-hole 22 such that the perforated plate 24 covers the opening 12*b* on both sides, and supports the two perforated plates 24 fixed to the frame 14*b*. Therefore, the frames 14 have higher stiffness than the film 18 (specifically, both the mass and the stiffness of the frame 14 per unit area need to be high), but the frames 14 may have stiffness equivalent to that of the perforated plate 24.

It is preferable that the shape of the frames 14 (14*a* and 14*b*) has a closed continuous shape capable of fixing the film 18 and the perforated plate 24 so as to restrain the entire outer periphery of the film 18 and the perforated plate 24. However, the present invention is not limited thereto. The frame 14 may have a discontinuous shape by cutting a part thereof as long as the frame 14 serve as a node of film vibration of the film 18 fixed to the frame 14 and the frame 14 supports the perforated plate 24. Since the role of the frame 14, that is, the role of the frame 14*a* is to fix the film 18 to control the film vibration and the role of the frame 14*b* is to support the perforated plate 24, the effect is achieved even in a case where there is a small cut in the frame 14 or there is a slightly unbonded part.

The shape of the opening 12 formed by the frame 14 is a planar shape. The shape of the opening is a square in the examples shown in FIGS. 1 and 2, but is not particularly limited in the present invention. For example, the shape of the opening 12 may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. End portions of the frame 14 on both sides of the opening 12 are not closed and but are open to the outside as they are. In the sound absorbing cells 20, the film 18 and the perforated plate 24 are fixed to the frame 14 so as to cover the opening 12 at at least one end portion of the opened opening 12.

The sizes of the frames 14 are sizes in plan view, and are defined as the sizes of the openings 12. In the case of a regular polygon such as a square shown in FIGS. 1 and 2 or a circle, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

In the soundproof structure 10 according to the embodiment of the present invention, the sizes of the frames 14 (that is, the size of the frame 14*a* to which the film 18 is attached in the sound absorbing cell 20*a* and the size of the frame 14*b* to which the perforated plate 24 is attached in the sound absorbing cell 20*b*) may be constant in all the frames 14 or all the frames 14 of the same kind of sound absorbing cells 20. Further, the frames 14 may have a frame having a different size (including the case of the different shape). In a case where the frames having different sizes are included, the average size of the frames 14 may be used as the sizes of the frames 14 of the same kind of sound absorbing cells 20.

The sizes of the frames 14 are not particularly limited, and the sizes of the frames may be set according to the soundproofing target to which the soundproof structures 10 according to the embodiment of the present invention are applied in order to perform the soundproofing. Examples of the soundproofing target include a copying machine, a blower, air conditioning equipment (air conditioner), an air conditioner outdoor unit, a ventilator, a pump, a generator, a duct, industrial equipment including various kinds of manufacturing equipment capable of emitting sound such as a coating machine, a rotary machine, and a conveyor machine, transportation equipment such as an automobile, a train, an aircraft, ships, bicycles (especially, electric bicycles), and personal mobility, and general household equipment such as a refrigerator, a washing machine, a dryer, a television, a copying machine, a microwave oven, a game machine, an air conditioner, a fan, a PC, a vacuum cleaner, an air purifier, a dishwasher, a mobile phone, a printer, and a water heater, office equipment such a projector, a desktop PC (personal computer), a notebook PC, a monitor, and a shredder; computer equipment using high power such as a server and a super computer; scientific experimental equipment such as a constant-temperature tank, an environmental testing machine, a dryer, an ultrasonic washing machine, a centrifuge, a washing machine, a spin coater, a bar coater, and a conveying machine, and consumer robots (such as cleaning applications, communication applications such as pet-friendly applications and guidance applications, and mobile assistance applications such as automobile chairs) or industrial robots.

The soundproof structure 10 itself can also be used like a partition in order to shield sound from a plurality of noise sources. In this case, the size of the frame 14 can also be selected from the frequency of the target noise. Of course, the structure in which the two kinds of sound absorbing cells 20*a* and 20*b* are integrally or separately arranged within the frame 14 which is an outer frame of the partition may be used as the soundproof structure according to the embodiment of the present invention.

It is preferable that the sizes of the frames 14 are decreased in order to obtain the natural vibration mode of the soundproof structure 10 including the frames 14 and the film 18 and including the sound absorbing cell 20*a* of the frame-film structure and the sound absorbing cell 20*b* of the frame-perforated plate structure on the high frequency side.

It is preferable that the average size of the frames 14 (14*a* and 14*b*) is equal to or less than the wavelength size corresponding to the peak frequency in order to prevent sound leakage due to diffraction at the absorption peak frequency (hereinafter, simply referred to as a peak frequency) of the soundproof structure 10 using the two kinds of sound absorbing cells 20 (20*a* and 20*b*).

For example, the sizes of the frames 14 are not particularly limited, and may be selected according to the sound absorbing cells 20. Regardless of whether the frames 14*a* and 14*b* are used, the sizes of the frames 14 are preferably 0.5 mm to 200 mm, more preferably 1 mm to 100 mm, and most preferably 2 mm to 30 mm. In a case where the frames 14*a* and 14*b* are arranged in the duct or the like, the frames 14*a* and 14*b* may have a size capable of being arranged in the duct or the like.

The sizes of the frames 14 may be represented as the average size depending on the kind in a case where the frames 14 have different sizes in the same kind of sound absorbing cells 20.

In addition, the widths (frame widths Lw) and the thicknesses (frame thicknesses Lt) of the frames 14 are not particularly limited as long as the film 18 and the perforated plates 24 can be fixed so as to be reliably restrained and the film 18 and the perforated plates 24 can be reliably supported. For example, the widths and thicknesses of the frames may be set depending on the sizes of the frames 14.

For example, in a case where the sizes of the frames 14 are 0.5 mm to 50 mm, the widths of the frames 14 are preferably 0.5 mm to 20 mm, more preferably 0.7 mm to 10 mm, and most preferably 1 mm to 5 mm.

In a case where the ratio of the width of the frame 14 to the size of the frame 14 is too large, the area ratio of the portion of the frame 14 with respect to the entire structure increases. Accordingly, there is a concern that the soundproof structure 10 as a device will become heavy. On the other hand, in a case where the ratio is too small, it is difficult to strongly fix the film with an adhesive or the like in the frame 14 portion.

In a case where the size of the frame 14 exceeds 50 mm and is equal to or less than 200 mm, the width of the frame 14 is preferably 1 mm to 100 mm, more preferably 3 mm to 50 mm, and most preferably 5 mm to 20 mm.

In addition, the thickness of the frame 14 is preferably 0.5 mm to 200 mm, more preferably 0.7 mm to 100 mm, and most preferably 1 mm to 50 mm.

It is preferable that the width and the thickness of the frame 14 are expressed by an average width and an average thickness, respectively, for example, in a case where different widths and thicknesses are included in each frame 14.

In the present invention, it is preferable that the frame body 16 arranged so as to connect one-dimensionally or two-dimensionally the plurality of, that is, two or more frames 14, preferably, one frame body 16 is provided.

Figure 6:
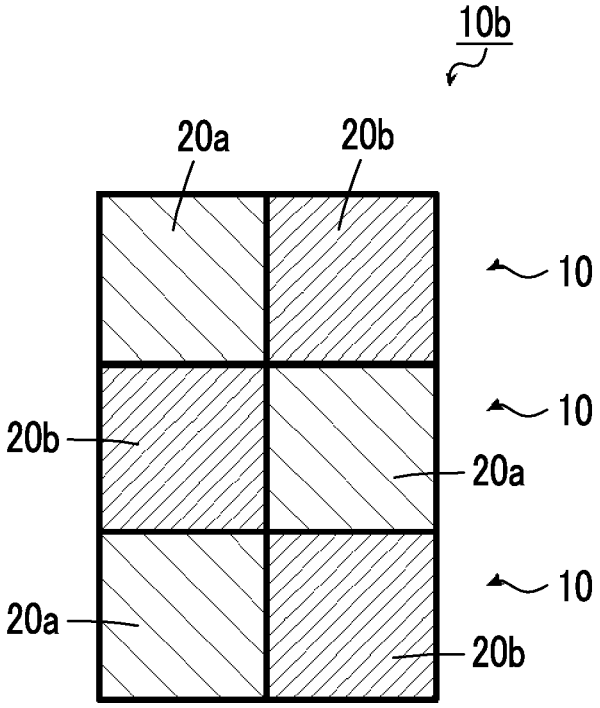
FIG. 6 is a schematic plan view of an example of a soundproof structure according to another embodiment of the present invention.

Here, the number of frames 14 of the soundproof structure 10 according to the embodiment of the present invention, that is, the number of frames 14 constituting the frame body 16 is two in the example shown in FIGS. 1 and 2, and the number of frames 14 constituting the frame body 16 is six in the soundproof structures 10*a* and 10*b* shown in FIGS. 5 and 6. However, the number of frames 14 is not particularly limited in the present invention, and may be set according to the soundproofing target of the soundproof structures 10, 10*a*, and 10*b* according to the embodiment of the present invention. Alternatively, since the sizes of the frames 14 are set according to the soundproofing target, the number of frames 14 may be set depending on the sizes of the frames 14.

For example, in the case of noise shielding within the device, the number of frames 14 is preferably 1 to 10000, more preferably 2 to 5000, and most preferably 4 to 1000.

The reason why the number of the frames 14 is limited is that since the size of the device is determined for the size of the general device, it is necessary to perform the shielding (that is, reflection and/or absorption) by using the frame body 16 obtained by combining the plurality of sound absorbing cells 20 in order to set the sizes of the pair of sound absorbing cells 20 (20*a* and 20*b*) as the sizes suitable for the frequency of the noise in many cases. The reason why the number of the frames 14 is limited is that the entire weight becomes large by the weight of the frames 14 by excessively increasing the number of sound absorbing cells 20. Meanwhile, in the structure such as the partition with no restriction on size, the number of frames 14 can be freely selected depending on the entire size to be required.

Since each of the soundproof structures 10, 10*a*, and 10*b* includes two frames 14 as the constitutional units, the number of frames 14 of the soundproof structure 10 according to the embodiment of the present invention is the sum of the number of sound absorbing cells 20.

The materials of the frames 14, that is, the materials of the frame body 16 are not particularly limited as long as the material can support the film 18 and the perforated plates 24, has a suitable strength in the case of being applied to the above soundproofing target, can arrange at least two kinds of sound absorbing cells 20, and is resistant to the soundproof environment of the soundproofing target, and the materials of the frame body 16 can be selected according to the soundproofing target and the soundproof environment. For example, metal materials such as aluminum, titanium, magnesium, tungsten, iron, steel, chromium, chromium molybdenum, nichrome molybdenum, and copper, and alloys thereof, resin materials such as acrylic resin, methyl polymethacrylate, polycarbonate, polyamideimide, polyarylate, polyether imide, polyacetal, polyether ether ketone, polyphenylene sulfide, polysulfone, polyethylene terephthalate, polybutylene terephthalate, polyimide, ABS resin (Acrylonitrile, Butadiene, Styrene copolymer synthetic resin), polypropylene, and triacetyl cellulose, carbon fiber reinforced plastics (CFRP), carbon fibers, and glass fiber reinforced plastic (GFRP) can be used as the materials of the frames 14.

A plurality of materials of the frame 14 may be used in combination.

The present structure may be used by being combined with a porous sound absorbing body. The porous sound absorbing body can be attached to various positions such as an air passage part attached to the frame on the film and a layer in the case of the film structure of two or more layers. The same effect as in a case where there is no porous sound absorbing body is obtained by adjusting the transmission phase with the porous sound absorbing body.

The porous sound absorbing body is not particularly limited, and the known porous sound absorbing body of the related art can be appropriately used. For example, foam materials and materials including minute air such as foamed urethane, flexible urethane foam, wood, ceramic particle sintered materials, and phenolic foam; fibers and nonwoven fabric materials, such as glass wool, rock wool, microfiber (such as synthrate (trademark) manufactured by 3M), floor mat, carpet, meltblown nonwoven fabric, metal nonwoven fabric, polyester nonwoven fabric, metal wool, felt, insulation board, and glass nonwoven fabric; wood cement board; and nanofiber-based materials such as silica nanofiber; gypsum boards; and various known porous sound absorbing materials can be appropriately used as the porous sound absorbing body.

The film 18 is fixed so as to be restrained by the frame 14*a* so that the opening 12*a* inside the frame 14*a* is covered, and the film 18 absorbs or reflects the energy of sound waves to insulate sound by performing film vibration corresponding to the sound waves from the outside. For this reason, it is preferable that the film 18 is impermeable to air.

Incidentally, since the film 18 needs to vibrate with the frame 14*a* as a node, it is necessary that the film 18 is fixed to the frame 14*a* so as to be reliably restrained by the frame 14*a* and accordingly becomes an antinode of film vibration, thereby absorbing or reflecting the energy of sound waves to insulate sound. Therefore, it is preferable that the film 18 is made of a flexible elastic material.

Therefore, the shape of the film 18 is the shape of the opening 12*a* of the frame 14*a*. In addition, the size of the film 18 is the size of the frame 14*a*. More specifically, the size of the film 18 can be the size of the opening 12*a* of the frame 14*a*.

As stated above, the film 18 is a film having a different thickness and/or different kind (physical properties such as density and Young's modulus), or a size such as a frame size so as to be attached to the frame 14*a*. In the soundproof structures 10, 10*a*, and 10*b* shown in FIGS. 1, 5, and 6, the film 18 fixed to the frame 14*a* of the sound absorbing cell 20*a* has the first resonance frequency at which the transmission loss is a minimum value, for example, 0 dB as the frequency of the lowest-order natural vibration mode (natural vibration frequency).

That is, in the present invention, the sound is transmitted at the first resonance frequency of the single-layer film 18 of the sound absorbing cell 20*a*.

Accordingly, in the soundproof structures 10, 10*a*, and 10*b* according to the embodiment of the present invention, for example, the film 18 of the sound absorbing cell 20*a* and the through-hole 22*a* of the perforated plate 24*a* of the two layers of perforated plates 24 of the sound absorbing cell 20*b* cause transmitted sound in which the phases of the transmitted waves are inverted on the sound transmission side, at the matching resonance frequency (for example, the first resonance frequency of the sound absorbing cell 20*a* and the first resonance frequency of the sound absorbing cell 20*b*). Thus, since the phases of the sound waves having the first resonance frequency which are transmitted through the film 18 of the sound absorbing cell 20*a* are inverted with respect to the phases of the sound waves having the same resonance frequency which are transmitted through the through-hole 22*b* of the perforated plate 24*b* of the sound absorbing cell 20*b*, the sound waves cancel each other through the interaction, and the transmitted waves reaching a far filed are reduced. Since the sound absorbing cells are resonating, a real part of acoustic impedance is very close to a value of air, and reflected waves are not almost generated for both the sound absorbing cell 20*a* and the sound absorbing cell 20*b* (a resonance phenomenon is defined as the matching of the acoustic impedance with a medium). Thus, the reflected waves are reduced due to the resonance phenomenon, and thus, the transmitted waves are reduced due to the cancelation interference. Accordingly, the incident waves are locally present around the sound absorbing cells, and are ultimately absorbed by the film vibration or the thermal viscous friction in the through-hole. Thus, the absorption peak is achieved at the first resonance frequency of the sound absorbing cell 20*b* matched with the first resonance frequency of the sound absorbing cell 20*a*. That is, as shown in FIGS. 3 and 4, at the matching resonance frequency of the film 18 of the sound absorbing cell 20*a* and the two layers of perforated plates 24 (24*a* and 24*b*) of the sound absorbing cell 20*b*, the absorption peak frequency in which the absorptance is maximized, that is, the absorption peaks, is obtained.

The soundproof structure according to the embodiment of the present invention comprises the single-layer film 18 on one side and the two layers of perforated plates 24 on the other side, and has two kinds or more of sound absorbing cells of which the first resonance frequency on one side and the first resonance frequency on the other side match each other, thereby obtaining the absorption peak frequency in which the absorption peaks at the matching resonance frequency of the two kinds of sound absorbing cells.

The principle of the soundproofing of the soundproof structure according to the embodiment of the present invention having such features can be considered as follows.

Initially, as described above, the frame-film structure of two kinds of sound absorbing cells of the soundproof structure according to the embodiment of the present invention has the first resonance frequency which is the frequency at which the film surface resonantly vibrates and the sound waves are greatly transmitted. The frame-perforated plate structure of the other kind of sound absorbing cell causes a resonance with the mass of the air in the through-hole and the spring characteristic by the compression and expansion of the air which is substantially confined therein, and causes the resonance frequency thereof to match the resonance frequency of the frame-film structure. The first resonance frequency on one side is determined by effective hardness such as the thicknesses of the film 18, the kinds (physical properties such as density and Young's modulus) of the film 18, and/or the size (the size of the opening 12*a* and the film 18), the width, and the thickness of the frame 14*a*. As the structure becomes hard, the structures have resonance points at the high frequency. As will be described later, the first resonance frequency on the other side is determined by the size of the two layers of perforated plates 24 (the size of the opening 12*b* of the frame 14*b*), the distance between the perforated plates (the frame thickness Lt of the frame 14*b*), the volume of gas substantially confined therein, and the type of gas (composition), the type and the plate thickness of the perforated plates 24, and/or the size (area, diameter, and effective diameter) of the through-holes of the perforated plates 24.

In a region of the first resonance frequency of the frame-film structure of one kind of sound absorbing cell, the film fixed to the frame vibrates with the same phase, and the phases of the sound waves passed through the film at the time do not greatly change. In a region of the first resonance frequency of the frame-perforated plate structure of the other kind of sound absorbing cell, the air between the two layers of perforated plates is inverted and vibrates, and at this time, the phases of the sound waves incident from the one through-hole and passed through the other through-hole are inverted. That is, it can be said that the combination of two kinds of different sound absorbing cell structures having the frame-film structure and the frame-perforated plate structure is a combination in which the phases thereof are inverted from each other.

Here, since the sound waves are also wave phenomena, the strengthening or cancelation of the amplitudes of the waves due to the interference is caused. Since the sound waves having a phase which are transmitted through the one kind of frame-film structure (first sound absorbing cell) and the sound waves having a phase inverted with respect to the above phase, which are transmitted through the other kind of frame-perforated plate structure (second sound absorbing cell) cancel each other since the phases of the sound waves are opposite to each other. Thus, the sound waves cancel each other in the region of the matching resonance frequency of the two different kinds of sound absorbing cell structures (sound absorbing cells) having the frame-film structure and the frame-perforated plate structure. Particularly, the amplitudes of the waves are equal to each other and the phases are inverted at the frequencies at which the amplitudes of the sound waves transmitted through the frame-film structures, and very large absorption is caused.

This is the principle of the soundproofing of the soundproof structure according to the embodiment of the present invention.

The feature of the present invention is that there are two or more different kinds of sound absorbing structures (sound absorbing cells) having the frame-film structure (first sound absorbing cell) and the frame-perforated plate structure (second sound absorbing cell) and, depending on the purpose of use, the material and/or the thickness of the film can be variously selected and the material and the thickness of the perforated plate, and/or the size of the through-hole of the perforated plate can be variously selected. Accordingly, in the soundproof structure according to the embodiment of the present invention, films having various characteristics can be used as the film attached to the frame, and perforated plates having various characteristics can be used as the perforated plate fixed to the frame. Accordingly, in the present invention, it is possible to easily achieve the soundproof structure having a function of combining other physical properties or characteristics such as flame retardancy, light transmittance, and/or heat insulation.

Here, the thickness of the film 18 is not particularly limited as long as the film can vibrate by absorbing or reflecting the energy of sound waves to insulate sound. However, it is preferable that the film is thick in order to obtain a natural vibration mode on the high frequency side. In the present invention, for example, the thickness of the film 18 can be set according to the size of the frame 14*a*, that is, the size of the film 18.

For example, in a case where the size of the frame 14*a* is 0.5 mm to 50 mm, the thickness of the film 18 is preferably 0.005 mm (5 μm) to 5 mm, more preferably 0.007 mm (7 μm) to 2 mm, and most preferably 0.01 mm (10 μm) to 1 mm.

In a case where the size of the frame 14*a* exceeds 50 mm and is equal to or less than 200 mm, the thickness of the film 18 is preferably 0.01 mm (10 μm) to 20 mm, more preferably 0.02 mm (20 μm) to 10 mm, and most preferably 0.05 mm (50 μm) to 5 mm.

It is preferable that the thickness of the film 18 is expressed by an average thickness in a case where there are different thicknesses in one film 18 or in a case where there are different thicknesses in the films 18.

Here, in the soundproof structure 10 according to the embodiment of the present invention, the first resonance frequency of the film 18 in one frame-film structure including the frame 14*a* and the film 18 can be determined by geometric forms (for example, the shape and dimension (size) of the frame 14) of the frame 14*a*) of the frame 14*a* of the sound absorbing cell 20*a* and the stiffness (for example, the physical properties such as the thicknesses and flexibility of the film) of the film 18 of the sound absorbing cell 20*a*.

In the case of the same kind of film 18, as the parameter characterizing the first natural vibration mode of the film 18, a ratio [$a^2/t$] between the thickness (t) of the film 18 and the square of the size (a) of the frame 14, for example a ratio between the thickness (t) of the film 18 and the size of one side of the frame 14 in the case where the frame 14 is a regular square can be used. Here, in a case where this ratio [$a^2/t$] is equal (for example, a case where (t, a) is (50 μm, 7.5 mm) and a case where (t, a) is (200 μm, 15 mm)), the first natural vibration mode becomes the same frequency (that is, the same first resonance frequency). That is, the ratio [$a^2/t$] has a constant value, and thus, the scale law is established. Accordingly, it is possible to select an appropriate size.

The Young's modulus of the film 18 is not particularly limited as long as the film 18 has elasticity capable of vibrating in order to insulate sound by absorbing or reflecting the energy of sound waves even though the films have different Young's modulus. However, it is preferable to set the Young's modulus to be large in order to obtain the natural vibration mode on the high frequency side. In the present invention, for example, the Young's modulus of the film 18 can be set according to the size of the frame 14*a*, that is, the size of the film 18.

For example, the Young's modulus of the film 18 is preferably 1000 Pa to 3000 GPa, more preferably 10000 Pa to 2000 GPa, and most preferably 1 MPa to 1000 GPa.

The density of the film is not particularly limited as long as the film can vibrate by absorbing or reflecting the energy of sound waves to insulate sound even though the densities of the film 18 are different. For example, the density of the film 18 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In a case where a film-shaped material or a foil-shaped material is used as the material of the film 18, the material of the film 18 is not particularly limited as long as the material has a strength in the case of being applied to the above soundproofing target and is resistant to the soundproof environment of the soundproofing target so that the film 18 can vibrate by absorbing or reflecting the energy of sound waves to insulate sound, and the material of the film 18 can be selected according to the soundproofing target, the soundproof environment, and the like. A material or a structure capable of forming a thin structure such as a resin material capable of being formed in a film shape such as polyethylene terephthalate (PET), polyimide, polymethylmethacrylate, polycarbonate, acrylic (PMMA), polyamide imide, polyarylate (PAR), polyetherimide (PEI), polyacetal, polyetheretherketone, polyphenylene sulfide (PPS), polysulfone, polyethylene terephthalate, polybutylene terephthalate, triacetyl cellulose (TAC), polyvinylidene chloride (PVDC), low-density polyethylene, high-density polyethylene, aromatic polyamide, silicone resin, ethylene ethyl acrylate, vinyl acetate copolymer, polyethylene (PE), chlorinated polyethylene, polyvinyl chloride (PVC), polymethyl pentene (PMP), and polybutene, a metal material capable of being formed in a foil shape such as aluminum, chromium, titanium, stainless steel, nickel, tin, niobium, tantalum, molybdenum, zirconium, gold, silver, platinum, palladium, iron, copper, and permalloy, a material capable of being formed as a fibrous film such as paper and cellulose, nonwoven fabrics, films including nano-sized fibers, porous materials such as thinly processed urethane and synthrate, and carbon materials processed into a thin film structure can be used as the material of the film 18.

In addition to the metal material, various metals such as 42 alloy, Kovar, nichrome, beryllium, phosphor bronze, brass, nickel silver, tin, zinc, steel, tungsten, lead, and iridium can be used as the material of the film 18.

In addition to the resin material, resin materials such as cycloolefin polymers (COP), Zeonor, polyethylene naphthalate (PEN), polypropylene (PP), polystyrene (PS), aramid, polyethersulfone (PES), nylon, polyester (PEs), cyclic olefin copolymers (COC), diacetyl cellulose, nitrocellulose, cellulose derivatives, polyamide, polyoxymethylene (POM), and polyrotaxane (such as sliding ring material) can be used as the material of the film 18.

Glass materials such as thin film glass or fiber reinforced plastic materials such as carbon fiber reinforced plastics (CFRP) and glass fiber reinforced plastics (GFRP) can also be used as the material of the film 18. Alternatively, these materials may be combined.

In the case of using a metal material, metal plating may be performed on the surface from the viewpoint of suppression of rust and the like.

In addition, the film 18 is fixed to the frame 14*a* so as to cover one end portion of the opening 12*a* of the frame 14*a*.

Here, in the soundproof structures 10*a* and 10*b*, all the films 18 may be provided on the same sides of the openings 12*a* of the frames 14*a* of the plurality of sound absorbing cell 20*a*. Alternatively, some of the films 18 may be provided on one side of the openings 12*a* of the frames 14*a* of the plurality of sound absorbing cells 20*a*, and the remaining films 18 may be provided on the other side of the remaining openings 12*a* of the frames 14*a* of the plurality of sound absorbing cells 20*a*. Alternatively, the films 18 formed on one side and the other side of the openings 12*a* of the frames 14*a* of the plurality of sound absorbing cells 20*a* may be present together.

The method of fixing the film 18 to the frame 14*a* is not particularly limited. Any method may be used as long as the film 18 can be fixed to the frame 14*a* so as to serve as a node of film vibration. For example, a method using an adhesive, a method using a physical fixture, and the like can be mentioned.

In the fixing method of using an adhesive, an adhesive is applied onto the surface of the frame 14*a* surrounding the opening 12*a* and the film 18 is placed thereon, so that the film 18 is fixed to the frame 14*a* with the adhesive. Examples of the adhesive include epoxy based adhesives (Araldite (registered trademark) (manufactured by Nichiban) and the like), cyanoacrylate based adhesives (Aron Alpha (registered trademark) (manufactured by Toagosei) and the like), and acrylic based adhesives.

Similarly to the frame body or the film body, the adhesive can be selected from the viewpoint of heat resistance, durability, and water resistance. For example, various fixing methods using "Super X" series manufactured by CEMEDINE, "3700 series (heat-resistant inorganic adhesive)" manufactured by ThreeBond, or "Duralco series" which is heat resistant epoxy adhesive and is manufactured by Solar Wire Net, and as a double-sided tape, high tempera double coated tape 9077 manufactured by 3M can be selected for required characteristics.

As the fixing method using a physical fixture, a method can be mentioned in which the film 18 disposed so as to cover the opening 12*a* of the frame 14*a* is interposed between the frame 14*a* and a fixing member such as a rod, and the fixing member is fixed to the frame 14*a* by using a fixture such as a screw or small screw.

Next, as described above, the second sound absorbing cell 20*b* includes the frame 14*b* which has an opening 12*b*, and two layers of plates (perforated plates) 24 (24*a* and 24*b*) which respectively comprise through-holes 22 (22*a* and 22*b*), are fixed around the opening 12*b* of the frame 14*b*, and cover both end portions of the opening 12*b*.

Although the second sound absorbing cell 20*b* includes two layers of perforated plates 24 (24*a* and 24*b*) which cover both the end portions of the opening 12*b* in the example shown in FIG. 1, the present invention is not limited thereto. The second sound absorbing cell 20*b* may include perforated plates 24 which are three or more layers as long as the perforated plates are fixed around the opening 12*b* of the frame 14*b*, cover the opening 12*b*, and have the through-holes 22. That is, the second sound absorbing cell 20*b* according to the embodiment of the present invention may include a multiple-layer (perforated) plates which are at least two layers.

The second sound absorbing cell 20*b* shown in FIG. 1 includes the through-holes 22*a* and 22*b* respectively formed in both the perforated plates 24*a* and 24*b* respectively fixed to both the end portions of the opening 12*b* of the frame 14*b*. Therefore, since the other plate (for example, the perforated plate 24*b*) is not closed with respect to the through-hole 22*a* of the one plate (for example, the perforated plate 24*a*), the through-holes 22*a* and 22*b* are not complete Helmholtz resonance holes. On the outside of the through-hole 22*a* of the perforated plate 24*a* and the through-hole 22*b* of the perforated plate 24*b* of the second sound absorbing cell 20*b*, a resonance (hereinafter, referred to as a Helmholtz type resonance in the present invention) which is similar to the Helmholtz resonance and vibrates with inverted phases occurs in the sound waves.

That is, the perforated plate 24*a* having the through-hole 22*a* and the perforated plate 24*b* having the through-hole 22*b* integrally act on the sound waves. Accordingly, the sound waves having the resonance frequency which are incident on the through-hole of the one plate (for example, the through-hole 22*a* of the perforated plate 24*a*) resonate due to the Helmholtz type resonance, and the sound waves having the resonance frequency which are emitted from the through-hole of the other plate (for example, the through-hole 22*b* of the perforated plate 24*b*) resonate with inverted phases due to the Helmholtz type resonance.

Here, since the through-hole 22*a* of the perforated plate 24*a* and the through-hole 22*b* of the perforated plate 24*b* communicatively connect an inner space and an outer space of the second sound absorbing cell 20*b* to each other, these through-holes constitute the opening part of the present invention. That is, in the present invention, the opening part includes the communicating through-holes 22*a* and 22*b*.

The perforated plate 24 is used in the sound absorbing cell 20*b* of the soundproof structure 10 shown in FIG. 1. In the illustrated example, the through-holes 22 serving as the Helmholtz type resonance holes for pseudo Helmholtz resonance are perforated in the approximately central portions of the perforated plates 24.

Here, the perforated plate 24*a* has the through-hole 22*a*, and forms a space formed in a rear surface of the perforated plate 24*a* by the frame 14*b* and the other perforated plate 24*b* except for the through-hole 22*a* as a pseudo closed space closed except for the through-hole 22*b* of the perforated plate 24*b*. In contrast, the perforated plate 24*b* has the through-hole 22*b*, and forms a space formed in a rear surface of the perforated plate 24*b* by the frame 14*b* and the other perforated plate 24*a* except for the through-hole 22*b* as a pseudo closed space closed except for the through-hole 22*a* of the perforated plate 24*a*.

Since such perforated plates 24 can cause a sound absorbing action due to the Helmholtz type resonance similar to the Helmholtz resonance by communicatively connecting the pseudo closed space in the rear surfaces with outside air by using the through-holes 22 as the resonance holes, there is no need for film vibration as in the film 18 of the sound absorbing cell 20*a* shown in FIG. 1. Accordingly, the perforated plates 24 may be members having stiffness higher than or a thickness thicker than the film 18 of the sound absorbing cell 20*a* shown in FIG. 1.

Thus, the same plate material as the aforementioned materials of the frames 14 such as a metal material such as aluminum or a resin material such as plastic can be used as the material of the perforated plate 24. However, as long as the sound absorption due to the film vibration is not caused, the material of the perforated plate 24 may be a member having stiffness lower than or a thickness thinner than the material of the frame 14.

Although the perforated plates 24 are used in the example shown in FIG. 1, the present invention is not limited thereto. As long as the sound absorption effect due to the Helmholtz type resonance can be caused, the perforated plates may be films with through-holes made of film materials. As the films used for the sound absorbing cell 20*b* used as the Helmholtz type soundproof cell, any film material can be used as long as the sound absorption due to the film vibration is smaller than the sound absorption due to the Helmholtz type resonance at the Helmholtz resonance frequency or as long as the sound absorption due to the film vibration is not caused. However, the film used for the sound absorbing cell 20*b* needs to be a film having stiffness higher than or a thickness thicker than the material of the film 18 of the sound absorbing cell 20*a*.

In addition, although the circular through-hole 22 is formed in the perforated plate 24, the shape of the through-hole is not limited to this as long as the effect of the Helmholtz type resonance can be obtained. For example, the same effect can be obtained with the through-hole having various shapes such as a polygonal shape, a rectangular shape, or a slit-shaped penetration part.

In a case where the film with the through-hole is used as the sound absorbing cell 20*b* which is the Helmholtz type soundproof cell, the resonance frequency of the Helmholtz type resonance becomes the high frequency side and interferes with the film vibration in a case where the thickness of the film is thin. For this reason, it is preferable to use the perforated plates 24 made of plate materials.

The method of fixing the perforated plates 24 or the film having the through-hole to the frame 14*b* is not particularly limited as long as the pseudo closed space can be formed in the rear surface of the perforated plates 24 or the film having the through-hole, and the same method as the above-described method of fixing the film 18 to the frame 14 may be used.

Here, as shown in FIG. 1, one or two or more through-holes 22 perforated in the perforated plates 24 may be perforated in the perforated plate 24 that covers the opening 12 of the frame 14*b*. As shown in FIG. 1, the perforation positions of the through-holes 22 may be the middle of the perforated plates 24. However, the present invention is not limited thereto, and the perforation positions of the through-holes do not need to be the middle of the perforated plates 24, and the through-hole may be perforated at any position.

That is, the sound absorbing characteristics of the sound absorbing cell 20*b* are not changed by simply changing the perforation positions of the through-holes 22.

Although it has been described in the example shown in FIG. 1 that the through-hole 22*a* of the perforated plate 24*a* and the through-hole 22*b* of the perforated plate 24*b* are formed in the same positions in order to facilitate the passage of air as wind from the viewpoint of air permeability, the present invention is not limited thereto.

The number of through-holes 22 in the perforated plates 24 may be one. However, the present invention is not limited thereto, and two or more (that is, a plurality of) through-holes may be formed.

Here, in the sound absorbing cell 20*b*, it is preferable that the through-holes 22 perforated in the two perforated plates 24 are constituted by one through-hole 22 from the viewpoint of air permeability. The reason is that, in the case of a fixed opening ratio, the easiness of passage of air as wind is large in a case where one hole is large and the viscosity at the boundary does not work greatly.

In the present embodiment, the opening ratio (area ratio) of the through-hole 22 within the perforated plate 24 is not particularly limited, and may be appropriately set according to the sound absorbing characteristics. The opening ratio is preferably 0.01% to 50%, more preferably 0.05% to 30%, and even more preferably 0.1% to 10%. By setting the opening ratio of the through-hole 22 within the above range, it is possible to appropriately adjust the sound absorption peak frequency, which is the center of the soundproofing frequency band to be selectively soundproofed.

In the present invention, it is preferable that the through-hole 22 is perforated using a processing method for absorbing energy (for example, laser processing), or it is preferable that the through-hole 22 is perforated using a mechanical processing method based on physical contact (for example, punching or needle processing).

Therefore, in a case where one through-hole 22 or a plurality of through-holes 22 of the perforated plates 24 has the same size, in the case of perforating holes by laser processing, punching, or needle processing, it is possible to continuously perforate holes without changing the setting of a processing apparatus or the processing strength.

The size of the through-hole 22 may be any size as long as the through-holes can be appropriately perforated by the above-described processing method, and is not particularly limited.

However, from the viewpoint of processing accuracy of laser processing such as accuracy of a laser diaphragm, processing accuracy of punching processing or needle processing, or manufacturing suitability such as easiness of processing, the size of the through-hole 22 on the lower limit side may be equal to or greater than 2 μm. However, in a case where the size of the through-hole 22 is too small, since the transmittance of the through-hole 22 is too low, the sound is not incident before the friction occurs and the sound absorption effect cannot be sufficiently obtained. For this reason, it is preferable that the size (that is, diameter) of the through-hole 22 is 0.25 mm or more.

On the other hand, since the upper limit of the size (diameter) of the through-hole 22 needs to be smaller than the size of the frame 14*b*, the upper limit of the size of the through-hole 22 may be set to be less than the size of the frame 14*b*.

In the present invention, since the size of the frame 14*b* is preferably 0.5 mm to 200 mm, the upper limit of the size (diameter) of the through-hole 22 is also less than 200 mm. However, in a case where the through-hole 22 is too large, the size (diameter) of the through-hole 22 is too large and the effect of the friction occurring at the end portion of the through-hole 22 is reduced. Therefore, even in a case where the size of the frame 14*b* is large, it is preferable that the upper limit of the size (diameter) of the through-hole 22 is mm order. Since the size of the frame 14*b* is usually mm order, the upper limit of the size (diameter) of the through-hole 22 is also mm order in many cases.

Since the through-hole 22 needs to function as the resonance hole causing the suction action due to the Helmholtz type resonance, the size of the through-hole 22 needs to cause the suction action due to the Helmholtz type resonance. Therefore, the size of the through-hole 22 is preferably equal to or greater than the diameter of 0.25 mm at which the Helmholtz type resonance occurs. The upper limit needs to be less than the size of the frame 14, and is more preferably 10 mm or less, even more preferably 5 mm or less.

From the above, the size of the through-hole 22 is preferably a diameter of 0.25 mm to 10 mm, more preferably a diameter of 0.3 mm to 10 mm, and most preferably a diameter of 0.5 mm to 5 mm.

It is possible to achieve an absorptance of more than 50% in the structure in which the size of the soundproof structure according to the embodiment of the present invention is sufficiently smaller than the wavelength as an absorbing target. It is possible to manufacture the soundproof structure which achieves high absorptance that is not able to be achieved in the related art, which secondarily achieves air permeability and/or heat conductivity and which is not known in the related art with a relatively simple structure using the film vibration and the absorption using the through-hole. In the related art, since the sound absorption due to the single vibration or friction has been focused on and the interaction thereof and the orientation of the mode itself have not been focused, it is considered that it is not possible to conceive of distinguishing and precisely combining the resonant modes as in the present invention.

The soundproof structure according to the embodiment of the present invention is a technology for strongly absorbing any frequency of low to intermediate frequencies within the audible range, and does not need to add an extra structure such as the weight. Since the soundproof structure is the frame-perforated plate structure and/or the frame-film structure including only the frame and the film as the simplest configuration, the soundproof structure has excellent manufacturing suitability and advantages from the viewpoint of cost.

Since the technology for performing soundproofing (sound insulation) or the absorption of the sound (sound absorption) by the combination of the two different kinds of sound absorbing cells is used, the soundproof structure according to the embodiment of the present invention can be adopted to various soundproofing or sound absorption technologies and has versatility as compared to the related art in which the soundproofing or sound absorption effect is caused by means within one unit cell.

In the soundproof structure according to the embodiment of the present invention, the soundproofing effect can be determined by the hardness, density, and/or thickness of the film among the physical properties of the film and does not need to depend on other physical properties. In the soundproof structure according to the embodiment of the present invention, the soundproofing effect can be determined by the physical properties and dimensions of the frame. In the soundproof structure according to the embodiment of the present invention, the soundproofing effect can be determined by the physical properties and dimensions of the perforated plate, and the dimensions of the through-hole. As a result, in the soundproof structure according to the embodiment of the present invention, the various other excellent physical properties such as flame retardancy, high permeability, biocompatibility, heat insulation, and radio wave transmittance can be combined. For example, as for the radio wave transmittance, a radio wave transmittance is secured by combination of a frame material having no electric conductivity such as acryl and a dielectric film. Radio waves can be shielded by covering all the surfaces with a frame material having high electric conductivity such as aluminum or a metal film.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

Therefore, the film is preferably flame retardancy. As the film, for example, Lumirror (registered trademark) nonhalogen flame-retardant type ZV series (manufactured by Toray Industries) that is a flame-retardant PET film, Teijin Tetoron (registered trademark) UF (manufactured by Teijin), and/or Dialamy (registered trademark) (manufactured by Mitsubishi Plastics) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron)), and/or flame-retardant plastics such as flame-retardant acrylic (for example, Acrylite (registered trademark) FRI (manufactured by Mitsubishi Rayon)) can be mentioned.

As a method of fixing the film to the frame, a bonding method using a flame-retardant adhesive (Three Bond 1537 series (manufactured by Three Bond)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan)) and/or glass fiber reinforced resin (TECAPEEK GF 30 (manufactured by Enzinger Japan)) and/or to use a metal such as aluminum, an inorganic material such as ceramic, or a glass material.

As the adhesive, it is preferable to use a heat resistant adhesive (TB 3732 (Three Bond), super heat resistant one component shrinkable RTV silicone adhesive sealing material (manufactured by Momentive Performance Materials Japan) and/or heat resistant inorganic adhesive Aron Ceramic (registered trademark) (manufactured by Toagosei)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure according to the embodiment of the present invention is arranged outdoors or in a place where light is incident, the weather resistance of the structural member becomes a problem.

Therefore, as the film, it is preferable to use a weather-resistant film, such as a special polyolefin film (ARTPLY (registered trademark) (manufactured by Mitsubishi Plastics)), an acrylic resin film (ACRYPRENE (manufactured by Mitsubishi Rayon)), and/or Scotch Calfilm (trademark) (manufactured by 3M).

As a frame material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK) and/or NCF (Nagaoka Sangyou)) so that the film is not charged, it is possible to prevent adhesion of dust due to charging. It is also possible to suppress the adhesion of dust by using a fluororesin film (Dynoch Film (trademark) (manufactured by 3M)), and/or a hydrophilic film (Miraclain (manufactured by Lifegard Co.)), RIVEX (manufactured by Riken Technology Inc.) and/or SH2CLHF (manufactured by 3M)). By using a photocatalytic film (Raceline (manufactured by Kimoto)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, aerogel, a porous film, and the like.

As a method of removing adhering dust, it is possible to remove dust by emitting sound having the resonance frequency of a film and strongly vibrating the film. The same effect can be obtained even in a case where a blower or wiping is used.

[Wind Pressure]

The film is exposed to strong wind, and thus, the film is pressed. As a result, there is a possibility that the resonance frequency will be changed. Thus, nonwoven fabric, urethane, and/or a film is covered on the film, and thus, it is possible to suppress the influence of the wind.

The soundproof structure according to the embodiment of the present invention is basically configured as described above.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening part (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening part (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site to prevent leakage of a lot of noise around the construction site); and a soundproof member for tunnel (soundproof member installed in a tunnel to prevent noise leaking to the inside and outside the tunnel).

EXAMPLES

The soundproof structure according to the embodiment of the present invention will be described in detail by way of examples.

Sound insulation characteristics of the soundproof structure according to the embodiment of the present invention were analyzed. Hereinafter, Examples 1 and 2 will be described.

Example 1

As shown in FIGS. 1 and 2, the frame 14*a* having the opening 12*a* of 20 mm square was manufactured. The first sound absorbing cell 20*a* (cell A) was manufactured by fixing and bonding a peripheral portion thereof to the frame 14*a* by using a polyethylene terephthalate (PET) film (manufactured by Toray Industries, Inc., Lumirror) having 188 m as the film 18. A depth thickness (frame thickness Lt) of the frame 14*a* was 4.5 mm, and the PET film was fixed to only one side in the cell A. A thickness (frame width Lw) of the frame portion of the frame 14*a* was 1 mm.

As shown in FIGS. 1 and 2, an acryl plate having a thickness of 2 mm was prepared, and was processed by a laser cutter so as to match the opening 12*a* of the frame 14*a* of the first sound absorbing cell 20*a*. The circular through-hole 22 having a diameter of 2 mm was formed in a central portion of the acryl plate by a laser cutter. By doing this, two structures were manufactured as the perforated plates 24 (24*a* and 24*b*).

The opening 12*b* of the frame 14*b* of 20 mm square was manufactured, and the depth length (frame thickness Lt) of the frame 14*b* was 4.5 mm. The end portion of the perforated plate 24 (24*a* and 24*b*) constituted by the acryl plate in which the through-hole 22 is formed in both surfaces thereof is fixed to the edge part of the opening 12*b* on both sides of the frame 14*b*. That is, the second sound absorbing cell 20*b* (cell B) which is the structure in which the two perforated plates 24 (24*a* and 24*b*) comprising the through-holes 22 face each other with a distance of 4.5 mm was manufactured.

The cell A and the cell B are adjacent to each other. Since the openings 12*a* and 12*b* had a square shape whose one side is 20 mm and the through-holes 22 (22*a* and 22*b*) had a circular shape having a diameter of 2 mm, the opening ratio of the through-holes 22 (22*a* and 22*b*) was 0.3%.

The acoustic characteristics of the soundproof structure 10 were measured by using the acoustic tube. The result is shown in Table 1 and FIG. 3.

From Table 1 and FIG. 3, the absorptance has a peak (maximum value), and is 87% at 1460 Hz.

The acoustic characteristics were measured by a transfer function method using four microphones in a self-made aluminum acoustic tube. This method is based on "ASTM E2611-09: Standard Test Method for Measurement of Normal Incidence Sound Transmission of Acoustical Materials Based on the Transfer Matrix Method". As the acoustic tube, for example, an acoustic tube based on the same measurement principle as WinZac manufactured by Nippon Sound Engineering Co., Ltd. was used. It is possible to measure the sound transmission loss in a wide spectral band using this method. The soundproof structure of Example 1 was arranged in a measurement portion of the acoustic tube, and the sound transmission loss was measured in a range of 10 Hz to 4000 Hz. In this measurement range, multiple combinations of diameters of the acoustic tube or distances between the microphones are measured.

In general, as the distance between the microphones becomes large, measurement noise becomes low at the low frequency. Meanwhile, as the distance between the microphones becomes longer than wavelength/2 on the high frequency side, it is not possible to perform the measurement. Thus, the measurement was performed multiple number of times while changing the distance between the microphones. The acoustic tube is thick, and thus, it is possible to perform the measurement due to the influence of the higher-order mode on the high frequency side. Accordingly, the diameter of the acoustic tube was also measured by using multiple kinds of diameters.

The acoustic tube was appropriately selected according to the size of the soundproof structure 10 (all the two cells) of Example 1 so as to include the size of all the two cells, acoustic characteristics (that is, acoustic transmittance (T) and reflectance) were measured by using the transfer function method, and absorptance was obtained (A=1−T−R).

The obtained absorptance, transmittance, and reflectance are shown in FIG. 4. The opening ratio, absorption peak frequency, and peak absorptance of Example 1 are shown in Table 1.

It can be seen from FIG. 4 and Table 1 that the absorptance greatly exceeds 50% and an absorptance of 87% is obtained around 1460 Hz.

TABLE 1

| | First sound absorbing cell | Second sound absorbing cell | Opening ratio (%) | Absorption peak frequency (Hz) | Peak absorptance (%) |
|---|---|---|---|---|---|
| Example 1 | PET 188 μm | Two layers of perforated plates with holes | 0.3 | 1460 | 87 |
| Example 2 | PET 188 μm | Two layers of perforated plates with holes | 1.3 | 1440 | 68 |
| Comparative Example 1 | PET 188 μm | — | 30 | 1400 | 40 |
| Comparative Example 2 | PET 188 μm | Two layers of perforated plates with holes | 1.3 | 1450<br>2550 | 37<br>37 |

Comparative Example 1

The measurement was performed by using a structure in which the cell A and an opening cell including a frame that has a square shape same as the cell A and has an opening as the opening part are adjacent to each other. The opening ratio of the opening part of the opening cell was adjusted so as to have 30%. The opening ratio, obtained peak absorptance, and absorption peak frequency of Comparative Example 1 are shown in Table 1.

It can be seen from Table 1 that the maximum value of the absorptance does not exceed 50% in Comparative Example 1. Thus, assuming that there is no near-field interference of the sound, the absorptance is about 50% in the configuration in which the cell A and the cell B are merely arranged on the same plane as in Example 1.

Comparative Example 2

The structure was prepared in the same manner as in Example 1 except that the diameter of the hole penetrating the second sound absorbing cell 20*b* (cell B) was 4 mm instead of 2 mm in Example 1.

Figure 7:
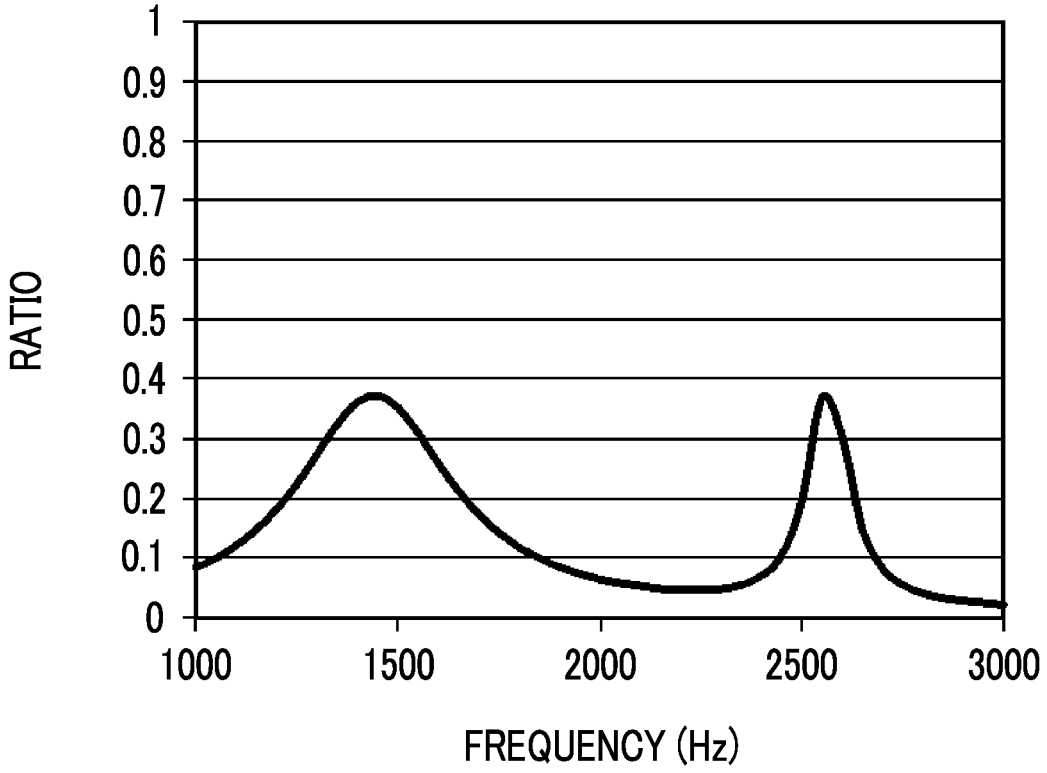
FIG. 7 is a graph showing soundproofing characteristics of a soundproof structure according to Comparative Example 2.

As the measured result, the peak absorptance was 37% and was caused at 1450 Hz and 2550 Hz. The measurement result is shown in Table 1. The measurement result of the absorptance is shown in FIG. 7.

In the case of this configuration example, since the resonance frequencies of the first sound absorbing cell and the second sound absorbing cell are shifted, absorption at each frequency was shown, but the absorptance was much lower than 50%.

Compared with Example 1, it is understood that the absorptance can be increased by matching the resonance even in the similar structure.

In the configuration of the present invention, the cancelation due to the near-field interference has an important function for improving absorption. In order to verify the fact, acoustic calculation was performed by modeling the soundproof structure of Example 1 by using an acoustic module of multiphysics calculation software "COMSOL version 5.1" using a finite element method.

Since the system of this soundproof structure is an interaction system of the film vibration with sound waves in the air, analysis was performed by using a coupled analysis of sound and vibration. Specifically, design was performed by using an acoustic module of COMSOL version 5.0 which is analysis software of the finite element method. Initially, a first natural vibration frequency was obtained through natural vibration analysis. Subsequently, the acoustic characteristics at each frequency for the sound waves incident from a front surface were obtained by performing acoustic structure coupled analysis due to frequency sweep in a periodic structure boundary.

A shape or material of a sample was determined based on this design. The absorption peak frequency from an experimental result and the predicted frequency from simulation match each other.

Example 2

The through-hole 22 having a diameter of 4 mm was formed on the acryl plate instead of the through-hole 22 having a diameter of 2 mm formed on the acryl plate in Example 1. Further, the depth length (frame thickness Lt) of the frame 14*b* was changed to 15 mm. Other than that, the soundproof structure 10 was produced in the same manner as in Example 1. That is, the sound absorbing cell 20*b* (cell C) which is the structure in which the two perforated plates 24 comprising the through-holes 22 (the perforated plate 24*a* with the through-hole 22*a* and perforated plate 24*b* with the through-hole 22*b*) face each other with a distance of 15 mm was manufactured.

The soundproof structure 10 in which the manufactured cell C and the cell A are adjacent to each other was manufactured. The acoustic characteristics of the manufactured soundproof structure 10 were measured by using the acoustic tube. The result is shown in Table 1 and FIG. 4.

From Table 1 and FIG. 4, the absorptance has a peak (maximum value), and is 68% at 1440 Hz.

It is possible to achieve an absorptance much higher than 50% even using the perforated plate 24 formed with the through-hole 22 as in Examples 1 and 2.

As stated above, in a case where the resonance of the single-layer film (cell A) and the Helmholtz type resonance of the through-hole of the perforated plate (cell B) match each other, an absorptance of more than 50% was obtained in an extremely thin structure. The absorption due to this resonance can function even in a case where the opening part (opening) by the through-hole of the cell B is present.

Since the phase change in a case where the sound waves pass through single-layer film and the phase change in a case where the sound waves pass through the resonance structure of the Helmholtz type resonance of the through-hole of the multiple-layer (for example, two-layer) perforated plate (cell B) cancel each other, it can be seen that a mechanism in which the transmitted waves of the resonances cancel each other, and the absorption is increased is achieved.

From the above, the effect of the soundproof structure according to the embodiment of the present invention is obvious.

While the soundproof structure according to the embodiment of the present invention has been described in detail with reference to various embodiments and examples, the present invention is not limited to these embodiments and examples, and various improvements or modifications may be made without departing from the scope and spirit of the present invention.

Since the soundproof structure according to the embodiment of the present invention can achieve a high soundproofing effect even in a compact, light, and thin structure which is much smaller than a wavelength, and can secondarily achieve air permeability and/or heat conductivity by providing a passage of air and/or heat, the soundproof structure according to the embodiment of the present invention can be used for soundproof of devices, automobiles, and general households.

EXPLANATION OF REFERENCES

10, 10*a*, 10*b*: soundproof structure
12, 12*a*, 12*b*: opening
14, 14*a*, 14*b*: frame
16: frame body
18: film
20, 20*a*, 20*b*: sound absorbing cell
22, 22*a*, 22*b*: through-hole
24, 24*a*, 24*b*: perforated plate
Lt: frame thickness
Lw: frame width

What is claimed is:

1. A soundproof structure comprising:
two or more kinds of resonant type sound absorbing cells including different kinds of a first resonant type sound absorbing cell and a second resonant type sound absorbing cell that are adjacent to each other; and
an opening part provided in the second resonant type sound absorbing cell,
wherein the opening part is a passage of heat and/or air in the soundproof structure,
a resonance frequency of the first resonant type sound absorbing cell and a resonance frequency of the second resonant type sound absorbing cell match each other,
the first resonant type sound absorbing cell includes a frame which has an opening, and a film which does not have a through-hole, and is fixed to the frame to cover the opening of the frame from one side, and
the second resonant type sound absorbing cell includes a frame having an opening, and two plates which include through-holes, respectively, and are fixed to the frame facing each other from both sides to cover the opening of the frame from both sides.

2. The soundproof structure according to claim 1,
wherein the opening of the frame of the first resonant type sound absorbing cell is directly opened to the outside of the soundproof structure.

3. The soundproof structure according to claim 1,
wherein the film is a single-layer film.

4. The soundproof structure according to claim 1,
wherein a first resonance frequency of the first resonant type sound absorbing cell including the film and a first resonance frequency of the second resonant type sound absorbing cell match each other.

5. The soundproof structure according to claim 1,
wherein each of the through-holes of the two plates is opened directly to the outside of the soundproof structure.

6. The soundproof structure according to claim 1,
wherein the opening part includes the through-holes of the two plates.

7. The soundproof structure according to claim 1,
wherein the two plates respectively are the same as each other.

8. The soundproof structure according to claim 1,
wherein the resonance frequencies matched in the first resonant type sound absorbing cell and the second resonant type sound absorbing cell are included in a range of 10 Hz to 100000 Hz.

9. The soundproof structure according to claim 1,
wherein, assuming that a wavelength at the resonance frequency is $\lambda$, the first resonant type sound absorbing cell that satisfies a condition in which a distance between the first resonant type sound absorbing cell and the second resonant type sound absorbing cell closest to the first resonant type sound absorbing cell is less than $\lambda/4$ occupies 60% or more of all of the first resonant type sound absorbing cells.

10. The soundproof structure according to claim 1,
wherein the opening part is directly opened to the outside of the soundproof structure, and is a passage for passing heat and/or air to the outside of the soundproof structure in the soundproof structure.

11. A soundproof structure comprising:
two or more kinds of resonant type sound absorbing cells including different kinds of a first resonant type sound absorbing cell and a second resonant type sound absorbing cell that are adjacent to each other; and
an opening part provided in the second resonant type sound absorbing cell, wherein a resonance frequency of the first resonant type sound absorbing cell and a resonance frequency of the second resonant type sound absorbing cell match each other, and wherein, assuming that a wavelength at the resonance frequency is λ, the first resonant type sound absorbing cell that satisfies a condition in which a distance between the first resonant type sound absorbing cell and the second resonant type sound absorbing cell closest to the first resonant type sound absorbing cell is less than λ/4 occupies 60% or more of all of the first resonant type sound absorbing cells.

12. The soundproof structure according to claim 11, wherein the first resonant type sound absorbing cell includes a frame which has an opening, and a film which does not have a through-hole, and is fixed to the frame to cover the opening of the frame from one side.

13. The soundproof structure according to claim 12, wherein the film is a single-layer film.

14. The soundproof structure according to claim 12, wherein a first resonance frequency of the first resonant type sound absorbing cell including the film and a first resonance frequency of the second resonant type sound absorbing cell match each other.

15. The soundproof structure according to claim 11, wherein the resonance frequencies matched in the first resonant type sound absorbing cell and the second resonant type sound absorbing cell are included in a range of 10 Hz to 100000 Hz.

16. The soundproof structure according to claim 11, wherein the opening part is directly opened to the outside of the soundproof structure, and is a passage for passing heat and/or air to the outside of the soundproof structure in the soundproof structure.

17. The soundproof structure according to claim 11, wherein the opening of the frame of the first resonant type sound absorbing cell is directly opened to the outside of the soundproof structure.

* * * * *